US010696364B2

(12) United States Patent
Harrington et al.

(10) Patent No.: US 10,696,364 B2
(45) Date of Patent: Jun. 30, 2020

(54) FRICTION-SEALED WATER IMMERSION SUIT

(71) Applicant: Ocean Rodeo Sports Inc., Victoria (CA)

(72) Inventors: Ross Davis Harrington, Victoria (CA); Peter G. Berrang, Saanichton (CA); Richard K. Myerscough, Victoria (CA)

(73) Assignee: OCEAN RODEO SPORTS INC., Victoria, BC (CA)

( * ) Notice: Subject to any disclaimer, the term of this patent is extended or adjusted under 35 U.S.C. 154(b) by 326 days.

(21) Appl. No.: 15/103,413

(22) PCT Filed: Jan. 15, 2015

(86) PCT No.: PCT/CA2015/050028
§ 371 (c)(1),
(2) Date: Jun. 10, 2016

(87) PCT Pub. No.: WO2015/109400
PCT Pub. Date: Jul. 30, 2015

(65) Prior Publication Data

US 2016/0332711 A1 Nov. 17, 2016

Related U.S. Application Data

(60) Provisional application No. 61/930,158, filed on Jan. 22, 2014.

(51) Int. Cl.
*B63C 11/04* (2006.01)
*A41D 13/012* (2006.01)
(Continued)

(52) U.S. Cl.
CPC ..... *B63C 11/04* (2013.01); *A41D 13/005* (2013.01); *A41D 13/012* (2013.01); *B63C 2011/043* (2013.01); *B63C 2011/046* (2013.01)

(58) Field of Classification Search
CPC ..... B63C 11/04; B63C 2011/046; B63C 2011/043; A41D 13/0005; A41D 13/012;
(Continued)

(56) References Cited

U.S. PATENT DOCUMENTS 2,173,468 A * 9/1939 Bennett ..... A41F 9/00 2/221
2,570,019 A 10/1951 Wolk
(Continued)

FOREIGN PATENT DOCUMENTS

WO 2005096854 A1 10/2005

OTHER PUBLICATIONS

International Search Report for corresponding PCT Application No. PCT/CA2015/050028 dated May 4, 2015.
(Continued)

*Primary Examiner* — Nathan E Durham
*Assistant Examiner* — Abby M Spatz
(74) *Attorney, Agent, or Firm* — Davis & Bujold PLLC; Michael J. Bujold

(57) ABSTRACT

A friction-sealed water immersion suit is described having a suit body with a neck opening, arm openings, leg openings and an entry opening. The entry opening defines an upper section and a lower section. A friction-sealed coupling is provided at the entry opening for coupling the upper section and the lower section of the suit body. The friction-sealed coupling includes a flap on one of the upper section or the lower section made of an elastomeric material and an inner flap and an outer flap on the other of the upper section or the lower section made of an elastomeric material. The friction-sealed coupling being engaged by interleaving the flap with the inner flap and the outer flap.

22 Claims, 26 Drawing Sheets

(51) Int. Cl.
*A41D 13/00* (2006.01)
*A41D 13/005* (2006.01)

(58) Field of Classification Search
CPC ..... A41D 19/0089; A41D 19/0044; A41D 19/0048; A41D 2400/44; A41D 2400/80; A41D 13/00; A41D 13/0002; A62B 17/001
USPC ..... 2/275, 2.15, 2.17, 456, 457, 168, 2.16, 2/123, 221, 237; 285/305
See application file for complete search history.

(56) References Cited

U.S. PATENT DOCUMENTS 2,778,027 A 1/1957 Bacon
2,941,210 A * 6/1960 Bren ..... A41D 27/10 2/115
3,731,319 A 5/1973 O'Neill
4,365,351 A 12/1982 Doerschuk et al.
4,464,795 A 8/1984 Long et al.
4,483,019 A * 11/1984 Spangrud ..... A41D 13/012 2/2.16
4,535,477 A 8/1985 Musto et al.
5,196,240 A 3/1993 Stockwell
5,630,229 A 5/1997 Machado et al.
5,647,059 A 7/1997 Uglene et al.
5,768,703 A 6/1998 Machado et al.
5,802,609 A * 9/1998 Garofalo ..... A41D 13/0005 2/2.15
5,896,578 A 4/1999 Hunter et al.
6,415,449 B2 7/2002 Duplock
6,668,386 B2 12/2003 Vidal
6,742,287 B2 * 6/2004 DeKalb ..... A43B 5/08 2/2.17
7,062,786 B2 6/2006 Stinton
7,313,829 B1 1/2008 Serra et al.
7,404,213 B2 7/2008 Lieberman
2005/0005337 A1 * 1/2005 Yokoyama ..... B63C 11/04 2/2.15
2007/0067886 A1 3/2007 Hunter et al.
2008/0109926 A1 * 5/2008 Lieberman ..... A41D 13/012 2/2.16
2013/0042377 A1 * 2/2013 Moore ..... A41D 13/012 2/2.16
2013/0216774 A1 * 8/2013 Conolly ..... B32B 15/046 428/135
2013/0254963 A1 * 10/2013 Milczarczyk ..... A41D 13/012 2/2.17

OTHER PUBLICATIONS

Written Opinion for corresponding PCT Application No. PCT/CA2015/050028 dated May 4, 2015.
International Preliminary Report on Patentability for corresponding PCT Application No. PCT/CA2015/050028 dated Mar. 4, 2016.

* cited by examiner

FRICTION-SEALED WATER IMMERSION SUIT

FIELD

The present invention relates to a friction-sealed water immersion suit for use as a wetsuit, drysuit or survival suit.

BACKGROUND

Wetsuits, drysuits and survival suits have been used worldwide for many years for water sports and water safety to provide thermal insulation for persons exposed to cold air, wind and rain, and/or immersed in cold water. Wetsuits are generally comprised of neoprene foam, designed to be tightly fitting to the user's body, which foam is an elastomeric polymer (polychloroprene) having a density range of 0.15-0.25 g/cc. Drysuits are generally comprised of non-stretch, loose fitting material, worn over an undergarment. Survival suits, which generally must be donned quickly during an emergency, are loosely fitting over a user's clothing, with tight seals at the neck, wrists and ankles.

A plethora of patents have been filed with respect to suit materials, suit entry and exit and sealing against skin to stop or minimize water intrusion. A key aspect of wetsuits is to minimize water intrusion at the wrist, ankle and neck. Interestingly, there is a perception amongst some users that it is acceptable to allow water entry into the suit, as such water will warm inside the suit, and provide insulation. This perception is incorrect, since heat transfers via conduction, convection and radiation and any water inside the suit would increase conduction, as water is some 25 times more conductive than air. Also, any water ingress into the suit would increase heat loss via convection. Thus, it is prudent to minimize the entry of any water into the wetsuit to ensure maximum thermal insulation. However, for drysuits and survival suits it is imperative that such suits remain dry, as any leak into the suit is potentially dangerous, and at best, would greatly reduce the suit's thermal insulation, which insulation is generally a woollen undergarment, which should not become wet. Also, any ingress of water into a drysuit or survival suit would change the suit's buoyancy, potentially endangering the user. Accordingly, most modern drysuits and survival suits seal against the skin at the neck, wrists and ankles by using a thin elastomeric material, such as neoprene, latex or silicone, which material is tightly stretched over the skin. Such prior art seals have openings with an inner circumference that is about 35% undersized so as to provide a highly compressive seal against the skin when donned by the user. For example, a user with a neck circumference of 42 cm, would use a neck seal with on (unstretched) circumference of about 27 cm. This high level of compression against the skin, especially at the neck, can be very uncomfortable, and restrictive for head movement. Also, the use of a highly undersized appendage opening requires the sleeve/cuff to be significantly stretched during donning or doffing, which stretching thins such material, making it more prone to tearing. For example, a 35% undersized seal at the neck needs to be stretched about 130% to fit over the head. Thus, creating a comfortable, effective drysuit or survival suit seal is a challenge, especially at the neck, since such a seal cannot be too tight. Wetsuits generally leak somewhat, as the seals at the neck, wrists and ankles are comprised of neoprene foam with only modest compression against the skin surface, although some prior an discloses means for reducing such water ingress.

The prior art also generally discloses using "smooth surfaces" to facilitate reduced friction during suit donning and doffing, thus allowing easier entry of the head, hands and feet through the relevant constricted elastomeric openings. For example, neoprene wetsuits are often lined on the skin side with a stretchy layer of nylon/spandex, or a low friction coating, to increase tear resistance and to minimal friction against the skin during donning and doffing of the suit. In a further effort to reduce friction at the neck, ankles and wrists, the prior art discloses the use of relatively short seals, which shorter seals would reduce the overall sealing integrity. Ideally, coefficient of friction between the skin and overlying elastomeric layer should be as high as possible, thereby preventing the elastomeric layer from sliding along the skin during active engagement by the user, and thus potentially allowing water ingress. Also, the use of a longer sleeve contacting the skin would be beneficial for minimizing water ingress.

Another key aspect of wetsuits, drysuits and survival suits is easy entry and exit (i.e. donning and doffing) into and from the suit. To accommodate such donning and doffing issues, most modern wetsuits, drysuits and survival suits are designed to be either one-piece with a zipper for entry, or two-piece, where the two parts are sealed at the torso using, for example, a 360 degree zipper, multiple folds, connecting rings and/or belts or other materials encircling the torso. With the advent of reliable waterproof zippers, the use of one-piece suits now dominate commercially. Such zippers should preferably provide a sufficiently large opening for a person to don and doff the suit without help. However, zippers are not stretchy, and as such, their use greatly reduces overall suit stretch, making donning or doffing such a suit more difficult, especially for persons with restricted flexibility. Also, zippers tend to be expensive to install, and are prone to becoming stiff over time do to failure, corrosion or salt/dirt ingress, if not carefully maintained.

Various prior an exists disclosing wetsuits and drysuits with zippers. For example, U.S. Pat. No. 3,731,319 to O'Neill describes a wetsuit that has zipper across the back between the shoulders for entry and exit. U.S. Pat. No. 4,464,705 to Long, et. al. discloses a drysuit with a long diagonal zipper across the front for easy access. This patent also discloses an embodiment whereby the suit length can be adjusted to fit the diver's height once donned, where such adjustment is accomplished by folding over the excess length of the upper section at the torso. U.S. Pat. No. 5,802,609 to Garofalo shows a zipper design similar to the O'Neill patent, with the zipper located across the back. U.S. Pat. No. 6,415,449 B2 to Duplock shows a method of entry via a waterproof zipper shaped like a horseshoe around the neck seal, making closure of such a zipper location awkward. For ease of use, zippers should be installed at the front as zippers mounted oil the back are more difficult to access for opening and closing the suit. However, for suits for surfers, the zipper is generally installed in the back, as lying prune on a surfboard on top of a zipper is uncomfortable.

Some prior art has disclosed designs for one-piece wetsuits without zippers. For example, U.S. Pat. No. 5,768,703 to Machado discloses a double collar upper entry with an inner stretchable collar to allow the wearer to enter the suit without a zipper. An outer collar can be extend over the head of the wearer to seal against the wearer's neck. U.S. Pat. No. 5,896,578 to Hunter, et. al. also discloses a neck-entry wet suit, whereby a V-shaped cut-out enlarges the neck opening for entry, and seals such opening with a collar panel, using hooks and loops to secure closure of the panel. However, these designs require folding flaps, and mechanical means to hold such folds, to prevent water ingress at the neck, and as such, are not truly waterproof.

For donning or doffing a wetsuit, drysuit or survival suit, it is, in theory, more practical to use a two-piece suit overlapped at the torso. Such a suit can better fitter persons of different height, and one can don the top and bottom halves separately, which scenario is also highly beneficial in cases requiring urgent voiding. Doffing and donning of the suit is also far simpler, requiring minimum flexibility. Additionally, the frictional forces against the skin are reduced as each section can be donned or doffed separately. Accordingly, various prior art has been published disclosing two-piece wetsuits, dry suits and survival suits without zippers. For example, U.S. Pat. No. 2,570,019 to Wolk discloses what is essentially a drysuit for divers where the a jacket and pants are comprised of soft and flexible rubber which overlap at the waist, and which two parts can be joined by multiple overlapping folds. Such folds are held together by two interlocking bells. Sealing at the hands and head are accomplished by stretching highly elastic material to cling closely to the hands and head. U.S. Pat. No. 4,535,477 to Musto, et. al. discloses a two piece drysuit which is comprised of trousers and a jacket, which are sealed at the waist by rolling up annular rubber sealing flaps attached to the waist of the trousers and the bottom edge of the jacket. The two flaps are rolled up together and held in place by a separate tight fitting belt to prevent unrolling. US Patent Application 2013/0254963 A1 to Milezarczyk, et al. discloses a two-piece drysuit comprised of a trouser and top jacket, which parts can be interconnected at the waist using a so-called rolled seal. This application illustrates various configurations for overlapping the lop and lower suit flaps to improve the watertight seal, and also provides means to prevent the overlapping waist sealing flaps from disengaging during normal use. They further disclose at least one surface that is substantially smooth to form a good watertight seal with adjacent smooth surfaces of combined sealing flaps.

Another key aspect of wetsuits, drysuits and survival suits, irrespective of the suit being one-piece or two-piece, is the requirement to effectively, and comfortably, seal at the neck, wrists and ankles. Various prior art has been published to address such sealing requirements. For example, U.S. Pat. No. 3,731,315 to O'Neill describes a wetsuit with in-turned seals at the neck, ankles and wrist to form a substantially water tight seal. U.S. Pat. No. 4,365,351 to Doerschuk et. al. discloses a neck and wrist seal for use in a diving suit, which seals are comprised of open-cell neoprene foam with ail impervious skin layer on the inner surface, where such seals are sized to allow the user to push through the head or wrist, forming what is essentially a standard pressure seal. U.S. Pat. No. 5,196,240 to Stockwell discloses a seamless bodysuit for use as a wetsuit, drysuit or biohazard suit, which suit is formed by spraying an elastomeric material onto a textile substrate formed over a mannequin. Sealing at the wrist, ankle and neck openings is accomplished by overlapping the ends and covering with sprayed elastomeric material to provide an inside rubber seal. An adjustable external strap can be used to adjust the closure. U.S. Pat. No. 5,647,059 to Uglene, et al. discloses an inflatable neck seal sandwiched between a compressible material on the outside and a non-compressible material on the inside. Inflation of the seal deforms the inner compressible material to create a seal against the neck. U.S. Pat. No. 5,802,609 to Garofalo also discloses a similar sealing approach for use in a drysuit, whereby the suit sleeves, trousers and neck are folded inwards and stitched to form a tubular pocket containing an elastomeric beading. Similarly, U.S. Pat. No. 6,415,449 B2 to Duplock shows neck, ankle and wrist seals for a drysuit, where such seals use elastic material to fit closely against the skin to achieve a watertight seal. U.S. Pat. No. 6,668,386 B2 to Vidal discloses an adjustable neck seal for use in a drysuit, whereby an elastomeric pull cord is positioned within a tube encircling the neck opening, which cord can be tensioned to create a seal around the neck. U.S. Pat. No. 7,062,786 B2 to Stinton discloses a protective suit for use by divers, for survival or for protection from hazardous materials. Such suit uses water tight releasable seals at the waist, wrist, ankles and neck by using complementary shaped annular interlocking seal members extruded from polymeric material, with a second compressible polymeric material used to provide the seal. U.S. Pat. No. 7,313,829 B1 to Serra, et. al. discloses a novel reactive seal where a super absorbent water-swellable polymer blend, comprised of sodium polacrylate and poly-anionic beads is used to provide a neck, wrist and ankle seal by expanding upon contact with water, which expansion creates a pressure against a thin elastomeric membrane overlying the skin surface. However, these water swellable polymer beads are not actively reversible, and would need to be replaced after each use. Also, accidentally contacting water, for example, from spray or rain, would activate the beads, which activation is irreversible. US Patent Application 2007/0067886 A1 to Hunter, et. al., discloses a flexible neck seal for use in a wetsuit, whereby the closure is provided by the compressible seal between the flexible neck and wetsuit exterior, which compressive seal is induced by the tensile forces between specific anchor points on the exterior back and front of the wetsuit.

SUMMARY

According to one aspect, there is provided a friction-sealed water immersion suit having a suit body with a neck opening, arm openings, leg openings and an entry opening. The entry opening defines an upper section and a lower section. A friction-sealed coupling is provided at the entry opening for coupling the upper section and the lower section of the suit body. The friction-sealed coupling includes a flap on one of the upper section or the lower section made of an elastomeric material and an inner flap and an outer flap on the other of the upper section or the lower section made of an elastomeric material. The friction-sealed coupling being engaged by interleaving the flap with the inner flap and the outer flap.

It will be appreciated that the friction-seal coupling for the entry opening can be adapted for use in a one piece water immersion suit or in a two piece water immersion suit.

According to another aspect, there is provided a method of donning the above described friction-sealed water immersion suit. A first step is taken of donning the lower section of the suit body. A second step is taken of folding down the lower flap. A third step is taken of donning the upper section of the suit body. A fourth step is taken of folding up the outer upper flap. A fifth step is taken of folding up the lower flap over the inner upper flap on the upper section of the suit body. A sixth step is taken of folding down the outer upper flap over the lower flap.

The above described friction-sealed water immersion suit is a friction-sealed, low water intrusion wetsuit, drysuit or survival suit, where said suit is comprised of an upper and lower part, which parts are held together at the torso partially, or totally, by frictional forces induced by overlapping or interleaving snugly-fitting upper and lower elastomeric flaps, which flaps are preferably comprised of exposed closed-cell neoprene foam, and where sealing at the neck, wrists and ankles is accomplished via a double layer of elastomeric material, preferably neoprene, where the inner sleeve has a high-friction surface contacting the skin, and a perforated elastomeric outer sleeve to provide mechanical support, thermal insulation and water drainage.

The water immersion suit can be full-length, or it can have short arm sleeves and/or short leg sleeves. In one embodiment, said suit can be one-piece with a partial connection between the upper section and the lower section to allow for easy donning and doffing. The non-connected parts between the upper and lower sections are adapted to be frictionally sealed using overlapping flaps. In the preferred embodiment, the upper and lower sections of the suit are both comprised of neoprene, were the term "neoprene" herein includes both solid sheet and foamed neoprene. In an alternate embodiment, the upper section of the wetsuit is comprised of a shell material, such as waterproof nylon, "Gortex like" or similar elastomeric water-sealed breathable polymer material, and the lower section of the wetsuit is comprised of neoprene. We define "Gortex like" herein as a waterproof, breathable material comprised of either microporous polytetrafluoroethylene or polyurethane. In a further alternate embodiment, the lower section of the wetsuit is comprised of a shell material, such as waterproof nylon, "Gortex like" or similar elastomeric or water-sealed polymer material, and the upper section of the wetsuit is comprised of neoprene.

In the preferred embodiment, sealing at the torso is accomplished by interleaving a single flap from the lower section of the suit between two flaps from the upper section of the suit, where the contacting neoprene surfaces have a high friction exposed open-cell surface, and where the circumference of the outermost layer at the torso is the same as the underlying layer, or, preferably, smaller than the underlying layer. In an alternate embodiment, sealing at the torso is accomplished by interleaving one flop from the upper section of the suit between two flaps from the lower section of the suit, where the contacting neoprene surfaces have a high friction exposed open-cell surface, and where the circumference of die outermost layer at the torso is the same as the underlying layer, or, preferably, smaller than the underlying layer. In a further alternate embodiment, the frictional seal at the torso can also be accomplished by overlapping one flap from the upper section of the suit over, or under, the lower section of the suit, and where the circumference of the outermost layer at the torso is the same as the underlying layer, or, preferably, smaller than the underlying layer.

The overlapping or interleaving flaps can vary in thickness, so that they are thinner on the exposed edges, making the transition from the upper outer torso overlap to the lower body section less noticeable, and where the circumference of the outermost layer at the torso is the same as the underlying layer, or, preferably, smaller than the underlying layer. Such a design can minimize the possibility of the upper outer torso overlap peeling back if it is impacted by water or from snagging on equipment.

Sealing at the neck, wrists and ankles is accomplished via two elastomeric sleeves, preferably comprised of neoprene, with the inner sleeve (or cuff) being sized to be substantially "comfortably-fitting" with a high-friction surface, preferably exposed open-cell neoprene, contacting the skin. We define the term "comfortably-fitting" herein as an inner sleeve/cuff material whose inner circumference is 80-95% of the circumference of the appendage (i.e. neck, wrist or ankle). Such comfortably-fitting inner sleeve material can be an elastomeric rubber such as neoprene, silicone, latex, EPDM (ethylene propylene diene monomer), NBR (nitrile butadiene) or natural rubber, or a foamed elastomeric material such as neoprene, silicone or EPDM. A perforated outer sleeve at the neck, wrists and ankles is comprised of thicker material, preferably neoprene, to provide thermal insulation, mechanical protection and water drainage. This outer sleeve/cuff overlays the inner sleeve/cuff. An aspect of the invention is to provide a perforated outer sleeve at the neck, wrists and ankles, which sleeve has an inner circumference that is the same or smaller than the circumference of the underlying inner sleeve. The inner and outer sleeves at the neck, wrist and ankle are adapted to hold and seal respective hoods, gloves and boots, where such apparel is frictionally held to the suit between interleaved high-friction neoprene layers.

Another aspect of the invention is that the actual surface area of any high friction exposed closed-cell neoprene surface is larger than its geometric surface area. For a smooth neoprene surface, the actual surface area and its geometric surface area are equal, or substantially equal. If one or both contact surfaces are comprised of exposed open-cell neoprene, the actual contact area will be greater than the geometric surface area. A further aspect of the invention is that the actual surface contact area between two roughened neoprene foam surfaces at the torso, or hood, gloves and boots, is larger than the geometric area.

The inventive wetsuit design disclosed herein uses high friction "roughened" neoprene surfaces, which surfaces are overlapped or interleaved at the torso, to physically hold the upper and lower suit components together, without folding, rolling of suit material, or use of belts or compression means. The high-friction neoprene foam surfaces are formed from Taw neoprene foam in "bun form" which is hot-wire cut to expose the pore features within the closed-cell neoprene foam. This surface is sometimes (incorrectly) referred to as "open-cell" whereas, more correctly, it should be referred to as "exposed closed-cell". We define "roughened" surface herein as the surface resulting from "exposed closed-cell foam" cut from "bun form".

One aspect of the invention is that the use of roughened neoprene surfaces contacting each other creates approximately double the static coefficient of friction compared to smooth neoprene surfaces. For example, the coefficient of static friction between dry smooth neoprene surfaces is about 1.5, compared to u static coefficient of friction of about 2.9 between dry roughened neoprene surfaces. The static coefficient of friction of the contacting neoprene surfaces is greater than 1.5, preferably greater than 2.0, and preferably greater than 2.5. As a roughened neoprene surface has a higher actual surface area than a similar size geometric surface area, the total contact area of the "exposed closed-cell" neoprene surface is higher than a smooth neoprene surface, or fabric-covered neoprene. For a given pressure against a neoprene surface, more contact area will tend to reduce water incursion between roughened neoprene surfaces, as compared to smooth neoprene surfaces. The coefficient of friction of the contacting "exposed closed-cell" or roughened neoprene surfaces is increased by applying pressure to such contacting surfaces, which pressure is induced by making the circumference of the outermost layer at the torso the same as the underlying layer, or, preferably, smaller than the underlying layer. The static friction coefficient of such a roughened-surface or "exposed closed-cell" can be further enhanced by modifying the neoprene surface with a coating of a silicone material, or a silicone gel material, or a silicone foamed gel material.

In one embodiment, the inventive wetsuit is one-piece, with a partial connection on the front torso of the suit, between the upper section and the lower sections, to allow for easy donning or doffing. The non-connected part between the upper and lower sections is adapted to be frictionally connected and sealed, using overlapping flaps. The length of the non-connected part is at least 50% of the horizontal circumference of the suit at this point on the torso. To don the suit the upper section hinges forwards at the partial connected area creating an opening in the non-connected section, at the back of the suit, that the user can enter, first with feet and legs and then, by bending forwards at the waist, with hand, arms, head and torso. The overlapping torso flaps can be partial, in circumference, so that they only cover the opening or they can be completely around the circumference. The circumference of the partial upper outer torso flap is the same or smaller than the circumference of the partial upper inner torso flap.

In a further embodiment, the inventive wetsuit can be partial-length, with short arm sleeves and/or short leg sleeves. Such a design allows the user to have maximum flexibility for choosing an optimum suit configuration for use in variable weather conditions and different water/air temperatures. The arm sleeves are removable, or attachable, to the upper section of the suit using an interleaved overlapping frictionally sealed system similar to attaching hood, gloves and boots to the suit. The leg sleeves are similarly removable, or attachable, to the lower section of the suit using an interleaved overlapping frictionally sealed system.

To create a substantially sealed wetsuit, a core issue is effectively sealing against the human skin epidermal layer. This surface is comprised of pores, sweat glands and hair shafts, with a surface roughness in die range of about 20-80 microns, making sealing against such a surface a challenge. Accordingly, to achieve a reasonable water-tight seal at the skin-elastomer interface has historically required a high total force on the skin surface to achieve sufficient force-per-unit-area. Various prior art discloses the use of tightly-fitting smooth-surface elastomeric thin layers or sheets, or smooth-surface neoprene or silicone foam material for sealing against skin.

One aspect of the current invention addresses the issue of sealing against water intrusion at the neck, wrists and ankles by using a double sleeve approach, with a comfortably-fitting inner elastomeric sleeve contacting the skin, which inner sleeve is overlaid with a more tightly fitting thicker outer elastomeric sleeve to provide mechanical protection, thermal insulation and pressure to increase the friction at the skin surface. The outer sleeve is also adapted to provide water drainage from the space between the inner and outer sleeves by perforating the outer sleeve, thereby creating a diffuser opening. Such sleeve perforation is beneficial because it diffuses the water pressure that is forced under the outer sleeve, thus preventing the outer sleeve from folding back on itself and/or ballooning open which in turn can reduce the sealing ability of the inner sleeve. The diffuser holes are spaced around the circumference of the outer sleeve at the torso, neck, wrist and ankle. The holes can be singular or a multiple rows of holes, or offset rows of holes. The holes can be any shape. However circular, triangular or squared holes with the corners rounded are preferred, as such shape will resist tearing at the corners. The size and number of holes can vary depending on the application of the suit. Sports such as water skiing, wakeboarding, surfing, kite boarding and windsurfing, which involve high speeds and hence higher water pressure on impact, would preferably have more holes and/or larger holes. In the scenario where the user has donned boots, gloves and hood, the holes are preferably, located distal from the inside edge of boots, gloves and hood, so that the seal to the boots, glove and hood is maintained.

One aspect of the invention is the use of a roughened neoprene surface against dry skin, which roughened surface has been measured by the authors to increase the static coefficient of friction by 50% or more, compared to the prior art static coefficient of friction between dry skin and smooth neoprene, embossed neoprene or fabric covered neoprene. Further, the coefficient of static friction, and thus the sealing between the skin and inner sleeves at the neck, ankle and wrist, can be further improved by modifying the inner surface of the inner sleeve with a coating of a low durometer silicone material, a silicone gel material or a silicone foamed gel material.

For some situations, it is necessary for the user to don a hood, gloves and boots to provide for more thermal protection. Such extra apparel needs to be easy to don, using only one hand for the gloves, and create a substantially water-tight seal to the suit.

To achieve the donning and water-tight sealing of such apparel, the current invention discloses a convenient method using a similar frictional interleafing design as used for sealing the upper and lower sections of the wetsuit at the torso.

Modern neoprene foam wetsuit material is highly stretchable, stretching up to about 200%. Prior an stitched wetsuits have seams holding the wetsuit panels together that have minimal or no stretch, with high stress-loading at the seams during stretching, especially at the intersection of the seams. Such high stress-loading can cause the neoprene wetsuit to break at the stitches, tearing the glued area. It can also cause the seams to lose their waterproof properties by cracking the seams' waterproof coating or by delaminating the seams' waterproof tape. In areas where the seams intersect, the stress-loading becomes concentrated, causing the intersections to fail/tear. Prior art wetsuit designs incorporate slightly curved seams, mostly for aesthetics. Such curved seam lengths in relation to a straight line between two points on a seam is in the range of 100% to 105%. This means that the straight line distance between two points on a seam 25 cm long would have a maximum seam length of 26 cm. Since modern neoprene foam wetsuit material can stretch over 200%, the elongation of these slightly curved seams is insufficient to reduce seam stress-loading.

One aspect of the invention is modifying the seam patterns to minimize leaks, and to make the suit seams more robust. Such seam enhancement is accomplished via a novel wavy sinusoidal shaped scam pattern to hold suit panels together to improve wetsuit stretch and reduce seam stress-loading, and by including a unique configuration at seam intersections for increased tear-resistance and reduced water intrusion. It is an aspect of the invention to make seams with a wavy sinusoidal shaped length that are at least 110% longer than the straight line length between two points on the seam, thereby significantly reducing stress-loading on the seam.

To reduce the concentration of stress-loading at seam intersections, prior art wetsuit designs sometimes use small (2.5 cm diameter or smaller) circular or rectangular patches that are glued over the seam intersection. These patches are made from Melco tape, thin laminated neoprene and other materials. Although such patches help prevent the seam intersection from failing, they can transfer a large section of the stress-load to the perimeter of the patch, causing the seam to fail as it exits the patch. The circular or rectangular shape of these patches do not distribute tire stress-loading on the seams at the intersections. It is an aspect of the invention to use triangular shapes at three-point seams, or diamond shapes at four-point seams. By using such shaped patches, to cover the seam intersections, and by also aligning the corners to match up with the seams, the stress-loading on the seams is distributed. This design prevents the seam from failing as it exits the patch. To further enhance the distribution of the stress-loads, the sides of the patches can be made concave.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
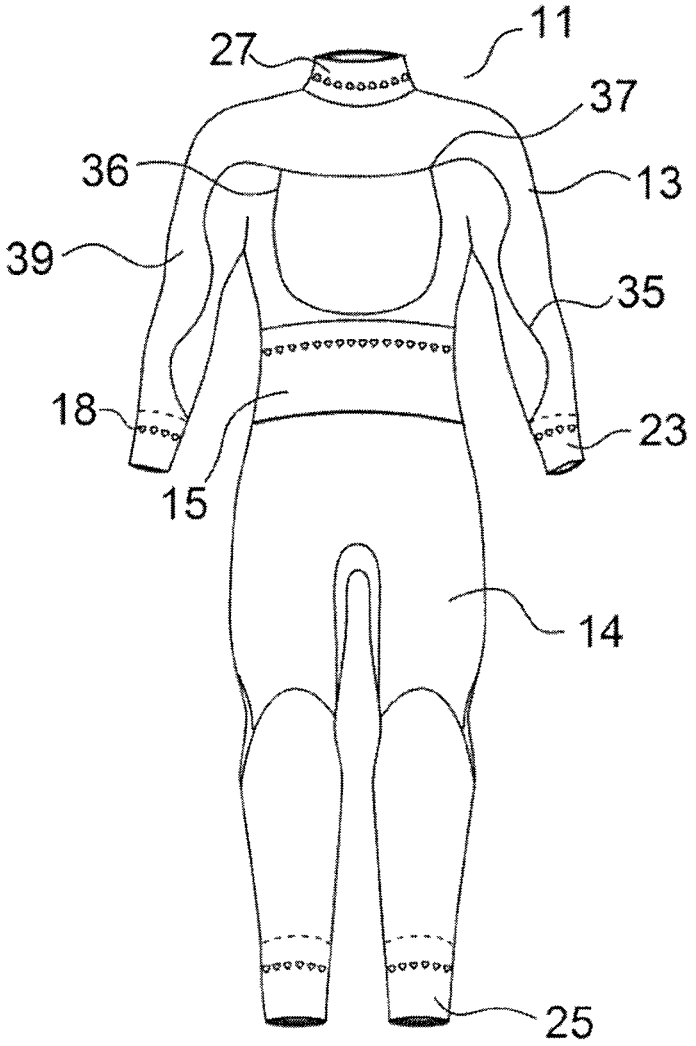
FIG. 1 is a front elevation view of a Friction-sealed water immersion suit.

FIG. 1 shows the front view of friction-sealed water immersion suit 11, with the upper outer torso flap 15 folded down over the lower body piece 14. Wavy stretch seam 35 is illustrated on upper body piece 13, and connected at seam junction 37 to seam 36 on suit panel 39. Friction-sealed water immersion suit 11 also shows outer wrist cuff 23 with diffuser openings 18, outer ankle cuff 25 and outer neck cuff 27.

Figure 2:
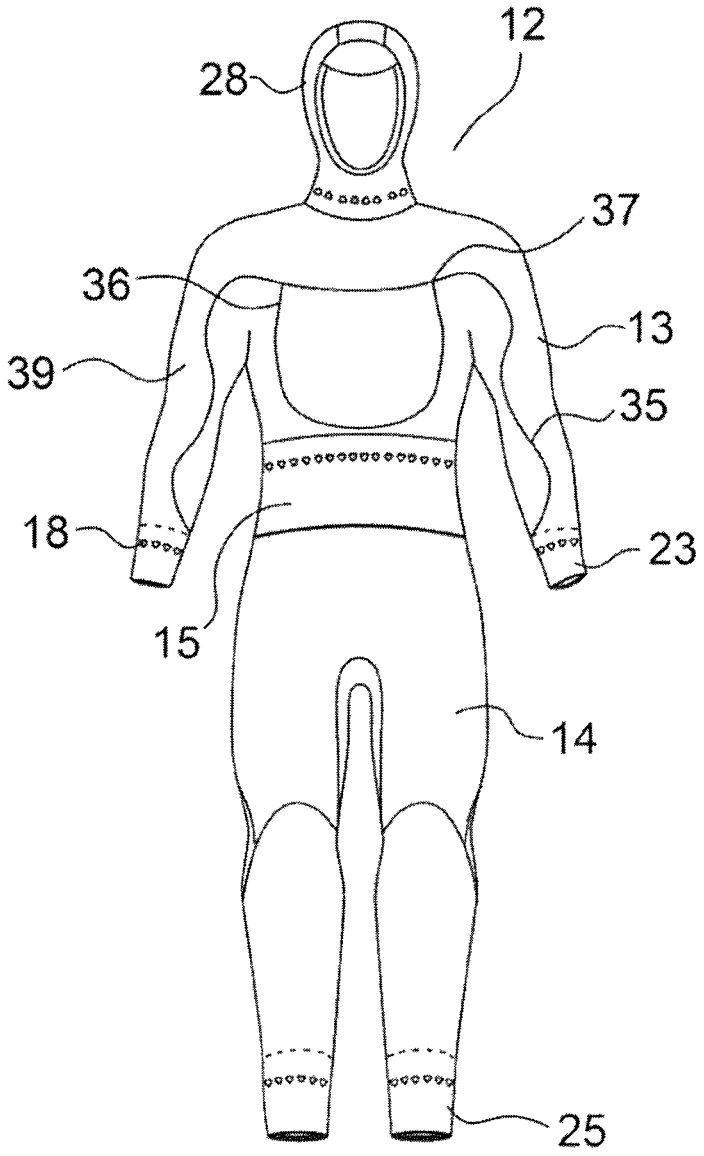
FIG. 2 is a front elevation view of the Friction-sealed water immersion suit of FIG. 1 with attached hood.
Figure 3:
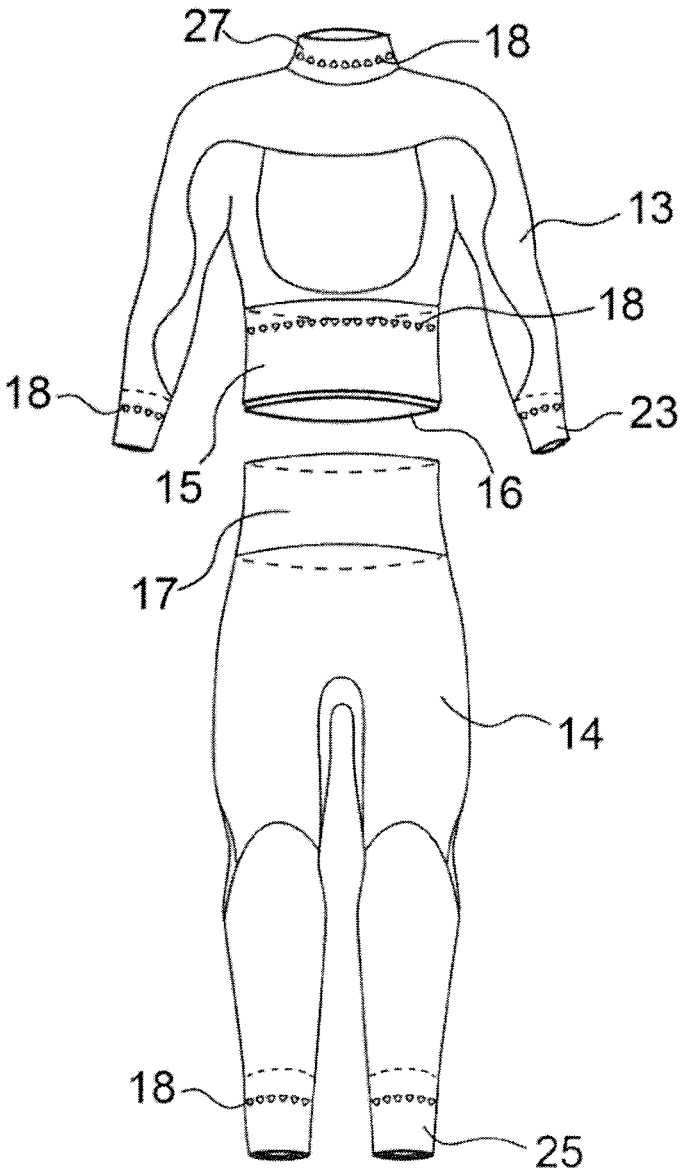
FIG. 3 is an exploded front elevation view of the Friction-sealed water immersion suit of FIG. 1 showing an upper piece and a lower piece separated.

FIG. 2 is similar to FIG. 1, but shows the from view of friction-sealed water immersion suit 12 with attached hood 28. A front view of friction-sealed water immersion suit 11 with the upper body piece 13 and lower body piece 14 separated is shown in FIG. 3. This figure also now shows the lower torso Hap 17 and inner upper torso flap 16. Additionally, FIG. 3 shows diffuser openings 18 on the upper outer torso flap 15, outer wrist cuff 23 and outer ankle cuff 25.

Figure 4:
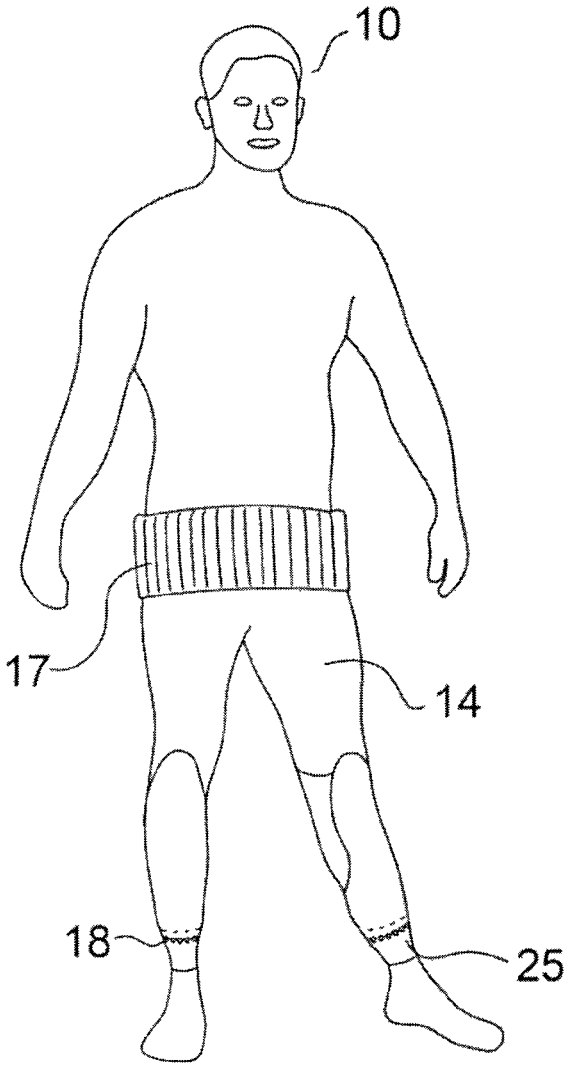
FIG. 4—Perspective view of user wearing lower suit section with the lower torso flap folded down FIG. 5—Perspective view of user wearing suit lower section and upper section, with the lower torso flap folded down, the inner upper torso flap folded down and the upper outer torso flap folded up FIG. 6—Perspective view of user wearing suit lower section and upper section, with the lower torso flap folded up over the inner upper torso flap and the upper outer torso flap folded up FIG. 7—Perspective view of user wearing suit lower section and upper section, with the upper outer torso flap folded down over the lower torso flap FIG. 8—Perspective view of the suit upper and lower sections showing the circumference of torso flaps and wrist and ankle cuffs FIG. 9—Sectional view of the upper and lower torso flaps FIG. 10—Sectional view of tapered upper and lower torso flaps FIG. 11—Perspective view of wrist cuff FIG. 12—Sectional view of wrist cuff FIG. 13—Sectional view of ankle cuff FIG. 14—Sectional view of neck cuff FIG. 15—Sectional view of wrist cuff with glove FIG. 16—Sectional view of ankle cuff with boot FIG. 17—Sectional view of neck with attached hood FIG. 18—Sectional view of neck cuff with removable hood FIG. 19—Flat view of stretch seam.
Figure 5:
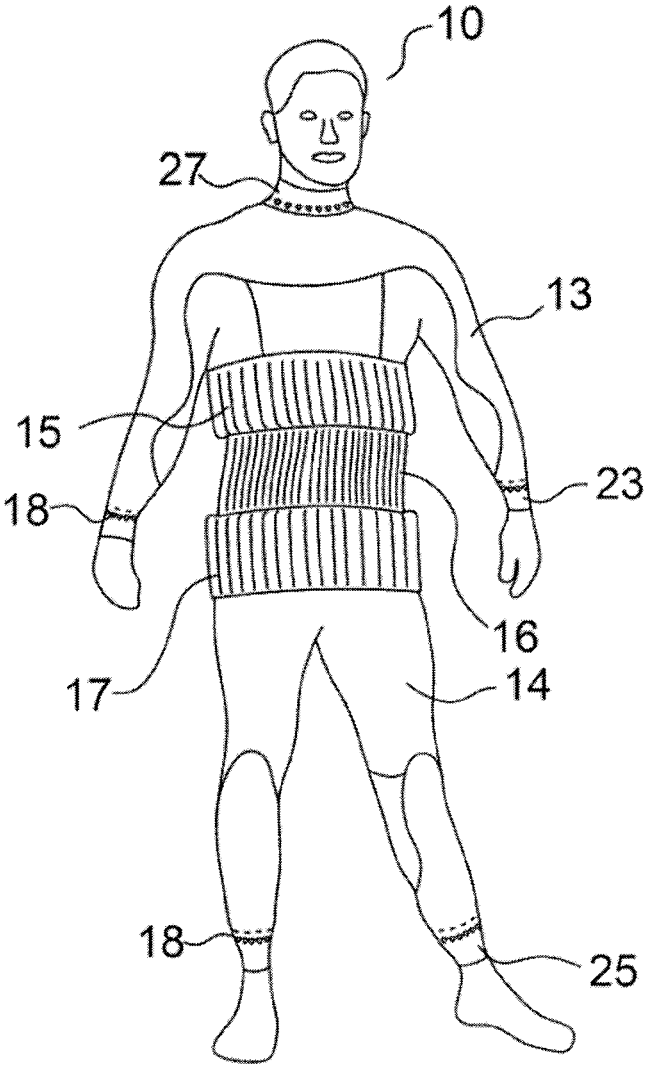
Figure 6:
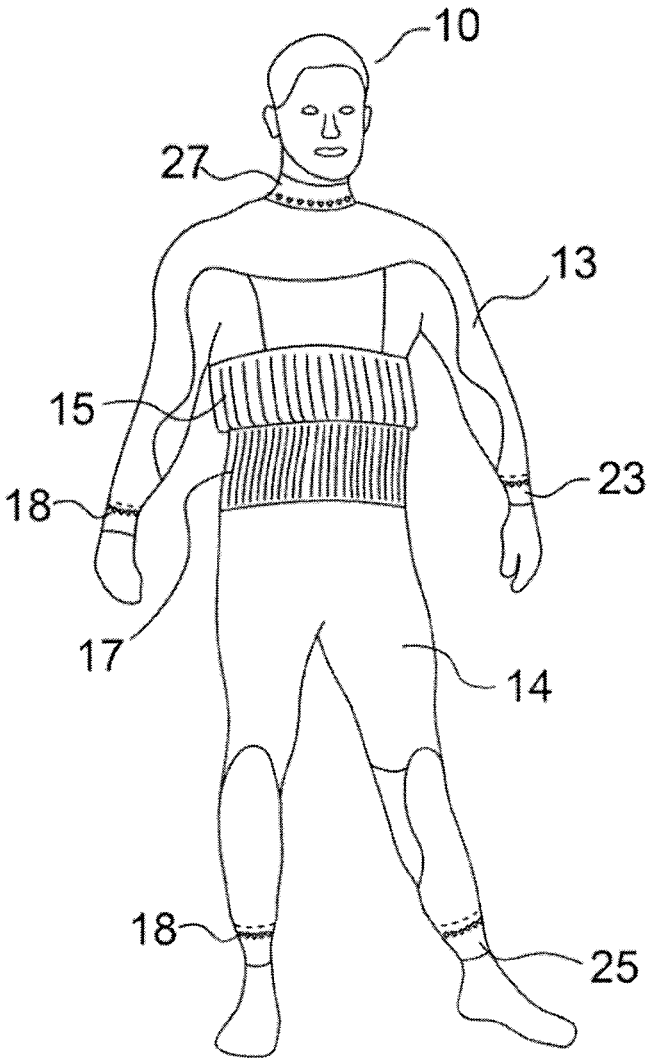
Figure 7:
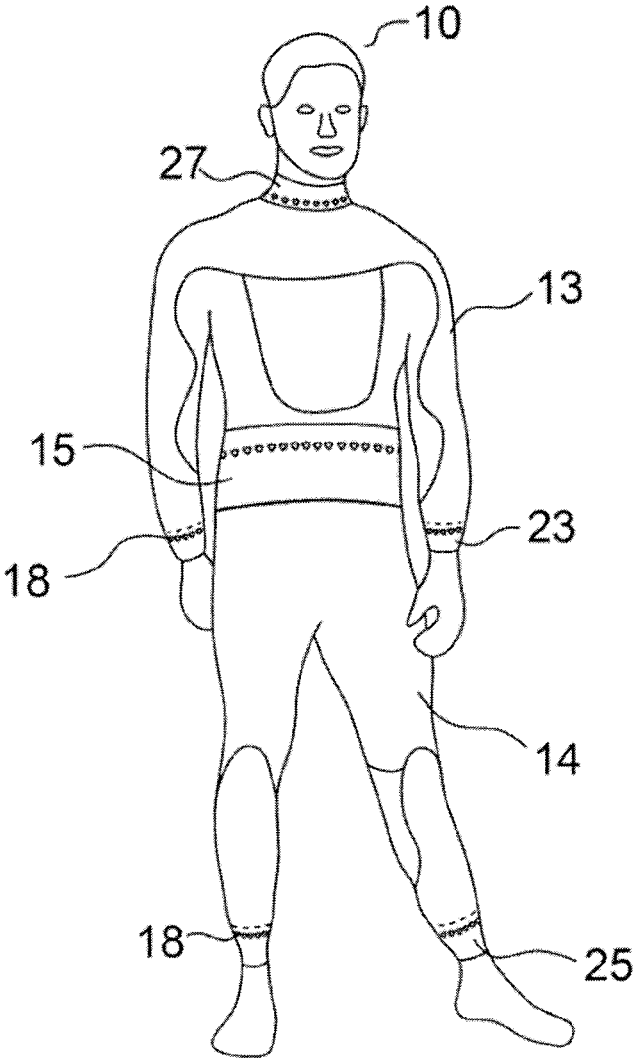

To don the friction-sealed water immersion suit 11, the user 10 would preferably don the lower body piece 14 first, and fold down the lower torso flap 17, as illustrated in FIG. 4. Then user 10 would don the upper body piece 13 and fold up upper outer torso flap 15, which scenario is shown in FIG. 5. Thereafter, user 10 would fold up lower torso flap 17 over upper inner torso flap 16, as illustrated in FIG. 6. Finally, user 10 would fold down upper torso flap 15 over the outer lower torso flop 17, forming a substantially watertight seal between upper body piece 13 and lower body piece 14, which configuration is shown in FIG. 7. Alternatively, the user could don the upper section of suit 11 first, and still interleaf the upper and lower suit sections as shown in FIG. 7. Also, in an alternate embodiment, the upper section of the suit could contain only one flap, and the lower section of the suit could contain an inner and outer flap, which flaps could be interleaved to provide a seal between the upper and lower suit sections.

Figure 8:
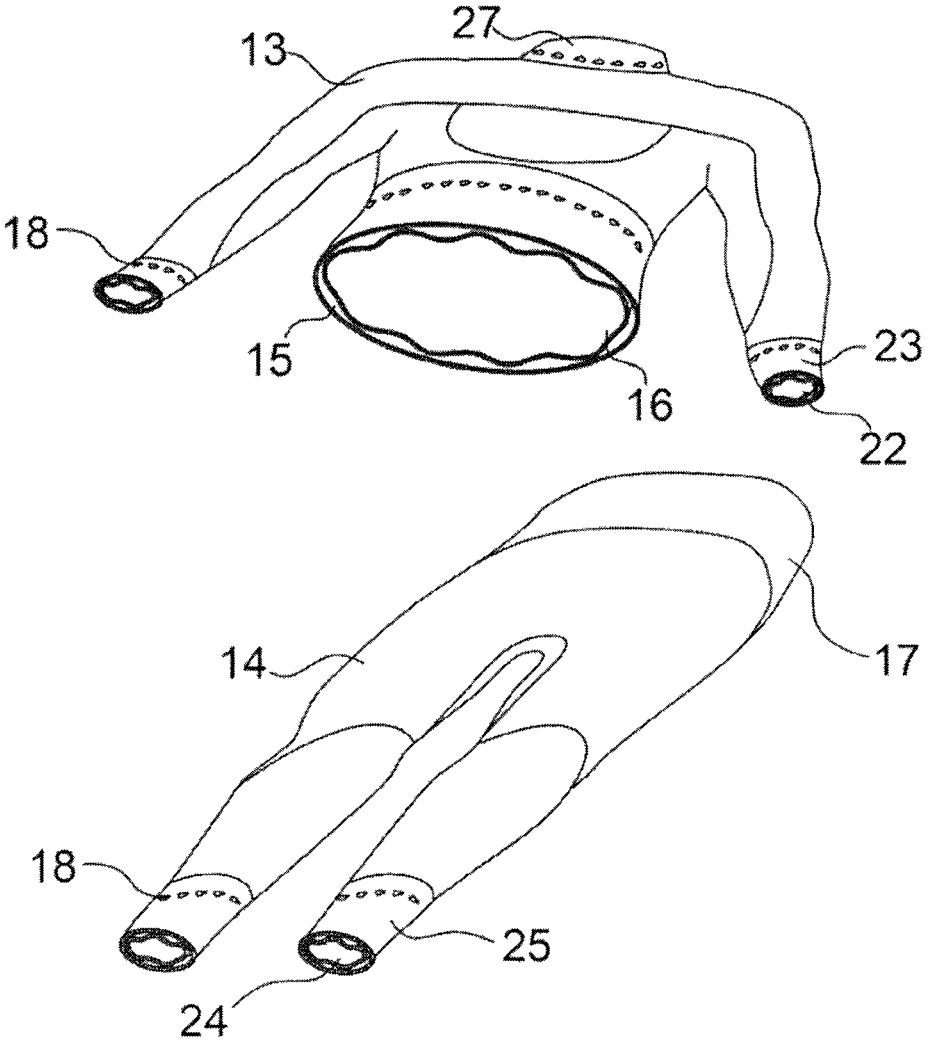

For further clarity, FIG. 8 depicts a perspective view of the suit upper section (or body piece) 13 and lower section (or body piece) 14, showing the circumference of torso flaps 15 and 16, inner and outer wrist cuffs 22 and 23 respectively, and inner and outer ankle cuffs 24 and 25 respectively.

An aspect of the current invention is that the circumference of upper outer torso flap 15 is the same or smaller than the diameter of inner upper torso flap 16. This aspect ensures that there is some compression between torso flaps 15 and 16 when lower torso flap 17 is interleaved there between, thereby enhancing frictional forces between torso flap 17 and the outer side of upper torso flap 16 and the inner side of upper torso flap 15.

Figure 9:
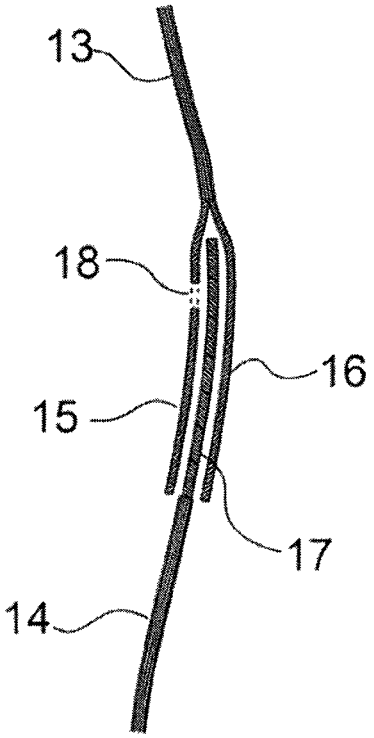

FIG. 9 illustrates a sectional view of upper torso flap 13 and lower torso flap 14, where the lower torso flap 14 is interleaved between the upper outer torso flap 15 and upper inner torso flap 16. The length of the overlap between the upper torso flap 13 and lower torso flap 14 can vary from 3 cm to 50 cm, preferably from 15 cm to 30 cm, which length of overlap provides sufficient range for users of different heights, and which length creates sufficient friction between the "exposed closed-cell" contacting surfaces for sealing and prevented the upper and lower flaps from sliding and separating.

Diffuser holes 18 are shown on the upper outer torso flap 15, which holes can be any shape, singular or multiple rows. The size and number of holes can vary depending on the application of the suit. For example, for wetsuits used in sports such as kite boarding, stand-up paddleboarding, wake boarding and windsurfing, the holes are preferably round, triangular or square, with an open area of about 5-30 cm2 per hole.

Figure 10:
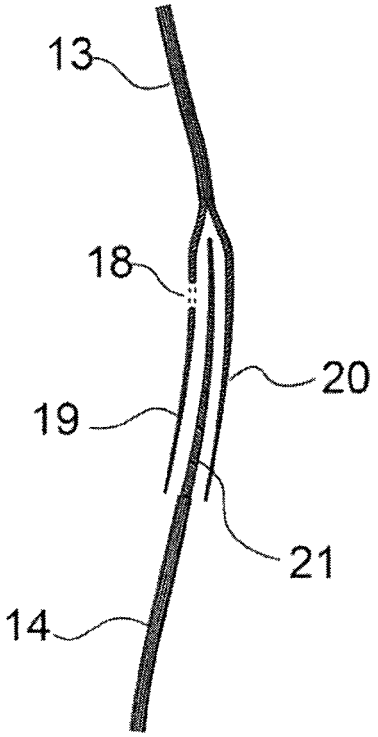

FIG. 10 is similar to FIG. 9, hut showing the upper outer torso flap 15 now tapered, which taper is shown as 19. Similarly, the inner upper torso flap 16 is tapered, shown as 20. Also, the lower torso flap 17 is now shown as tapered, illustrated as 21. Such tapering provides a less bulky, more aesthetic look of the overlapped torso section.

Figure 11:
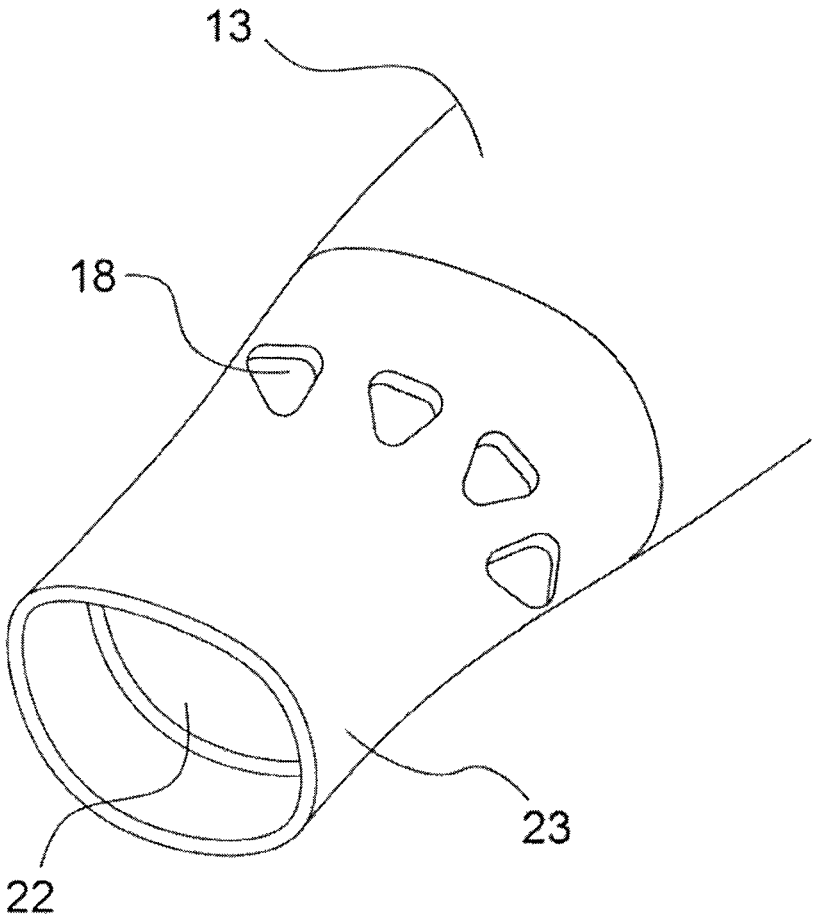
Figure 12:
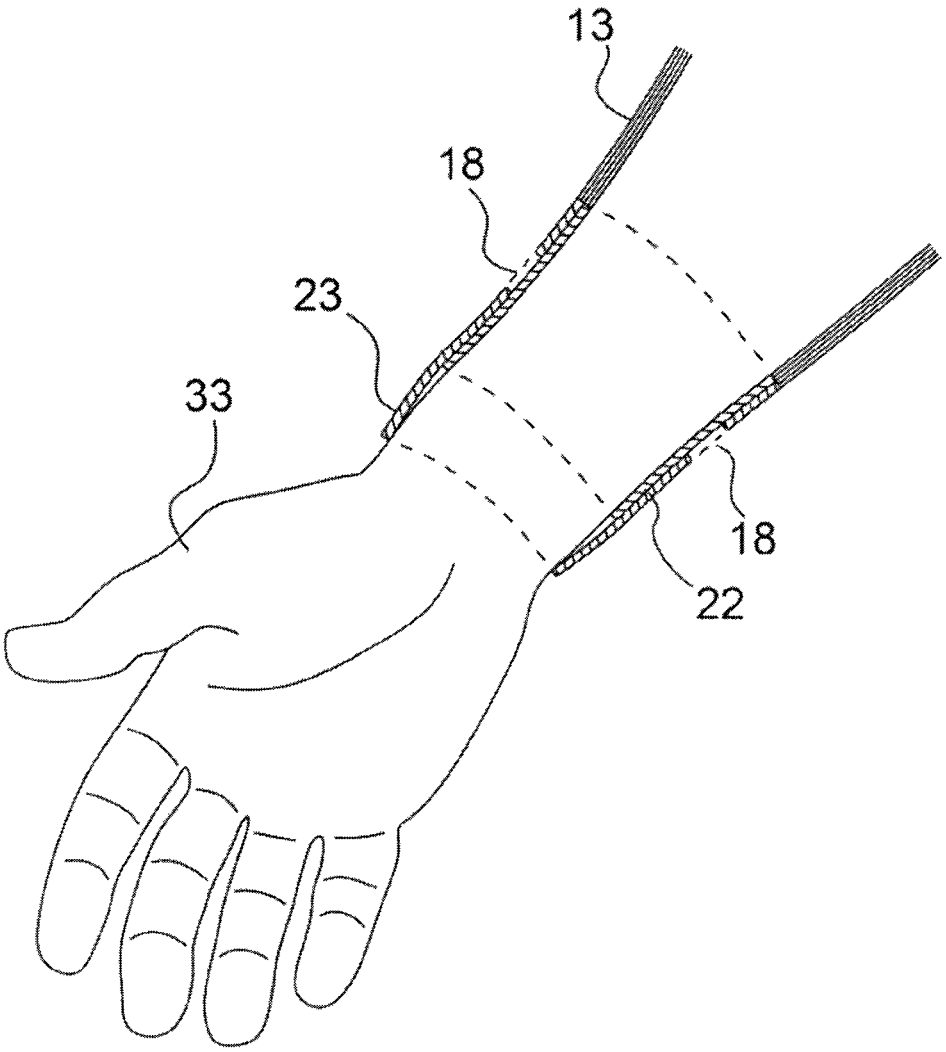

An enlarged perspective view of the outer wrist cuff 23 is shown in FIG. 11. Diffuser holes 18 are shown as triangular, although such holes can also be other shapes, such as round or square. FIG. 12 shows a sectional view of hand 33 with upper body piece 13 covering the user's wrist. Inner wrist cuff 22 is in intimate contact with the skin surface, and preferably slightly tapered, and compressed by outer wrist cuff 23, which cuff has the same, or preferably a smaller circumference than inner wrist cuff 22, thereby slightly compressing inner neck cuff 26 against the skin surface to create a substantially watertight seal. Diffuser holes 18 only perforate the outer wrist cuff 23, but not the inner wrist cuff 22.

Figure 13:
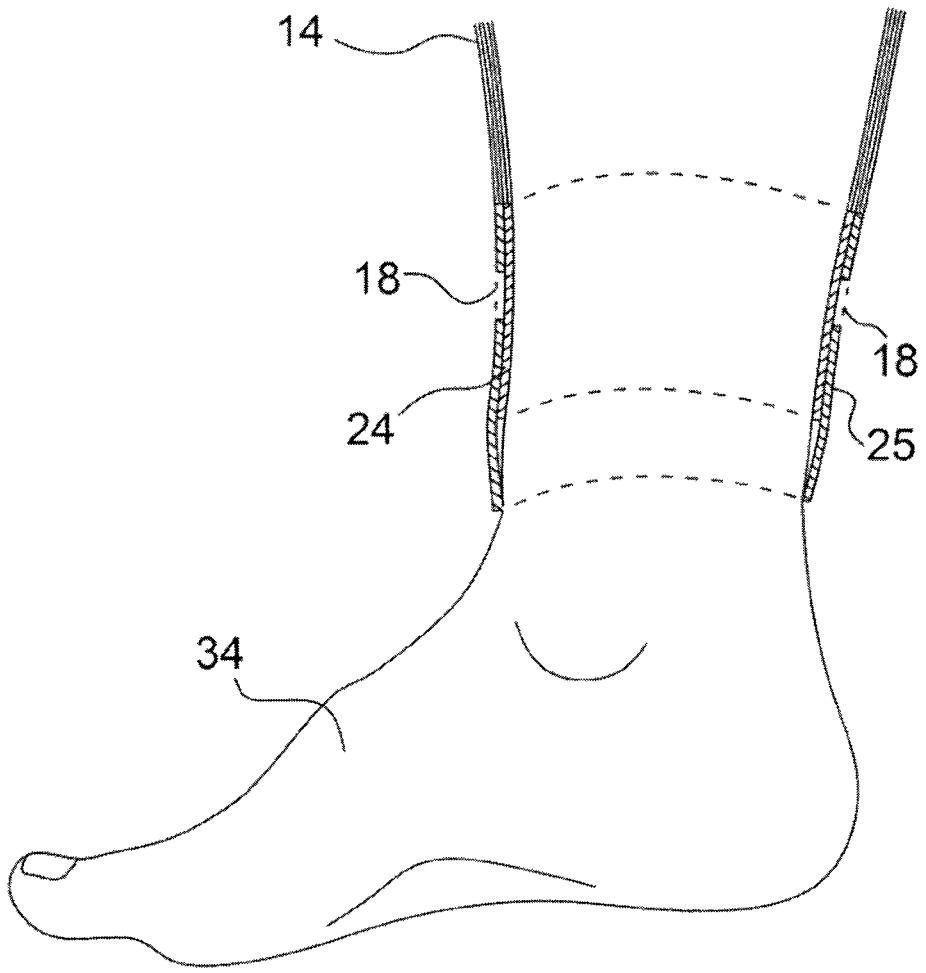

FIG. 13 shows a perspective view of foot 34 with the distal part of lower body piece 14 comprised of outer ankle cuff 25 and inner ankle cuff 24. Diffuser holes are shown as 18.

Figure 14:
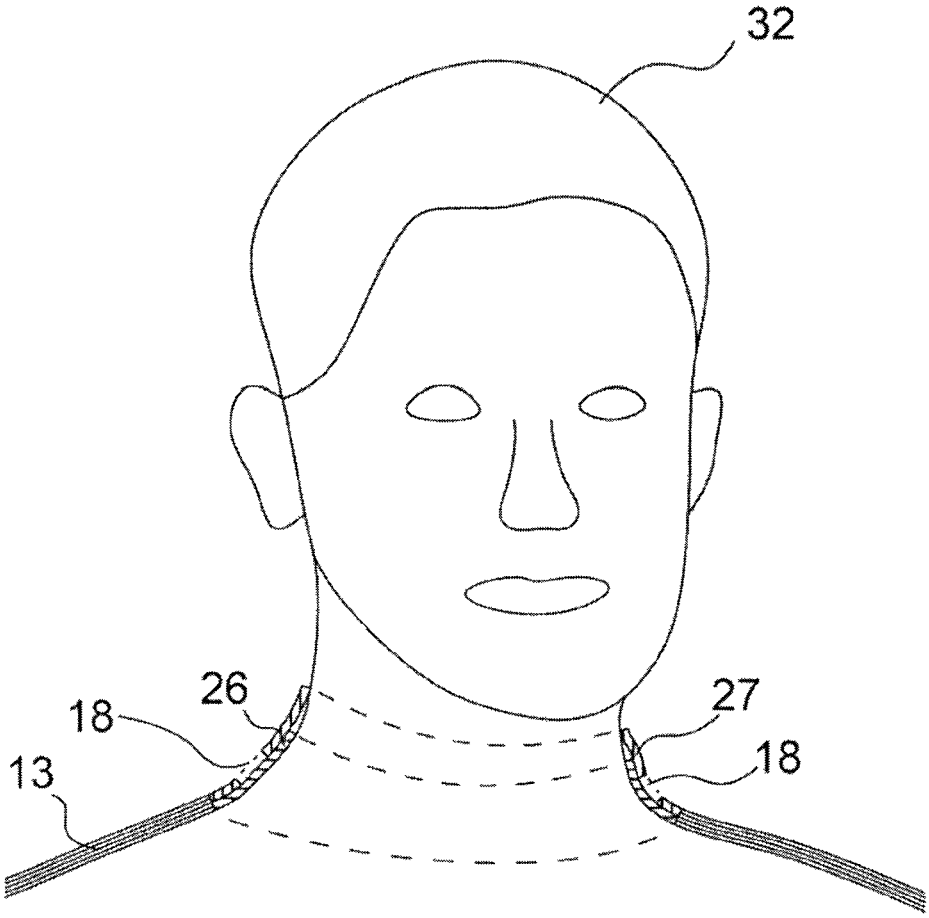

FIG. 14 illustrates a sectional view of outer neck cuff 27 and inner neck cuff 26, with diffuser holes shown as 18. The circumference of outer neck cuff 27 is the same, or preferably a smaller circumference than inner neck cuff 26, thereby slightly compressing inner neck cuff 26 against the skin surface to create a substantially watertight seal.

Figure 15:
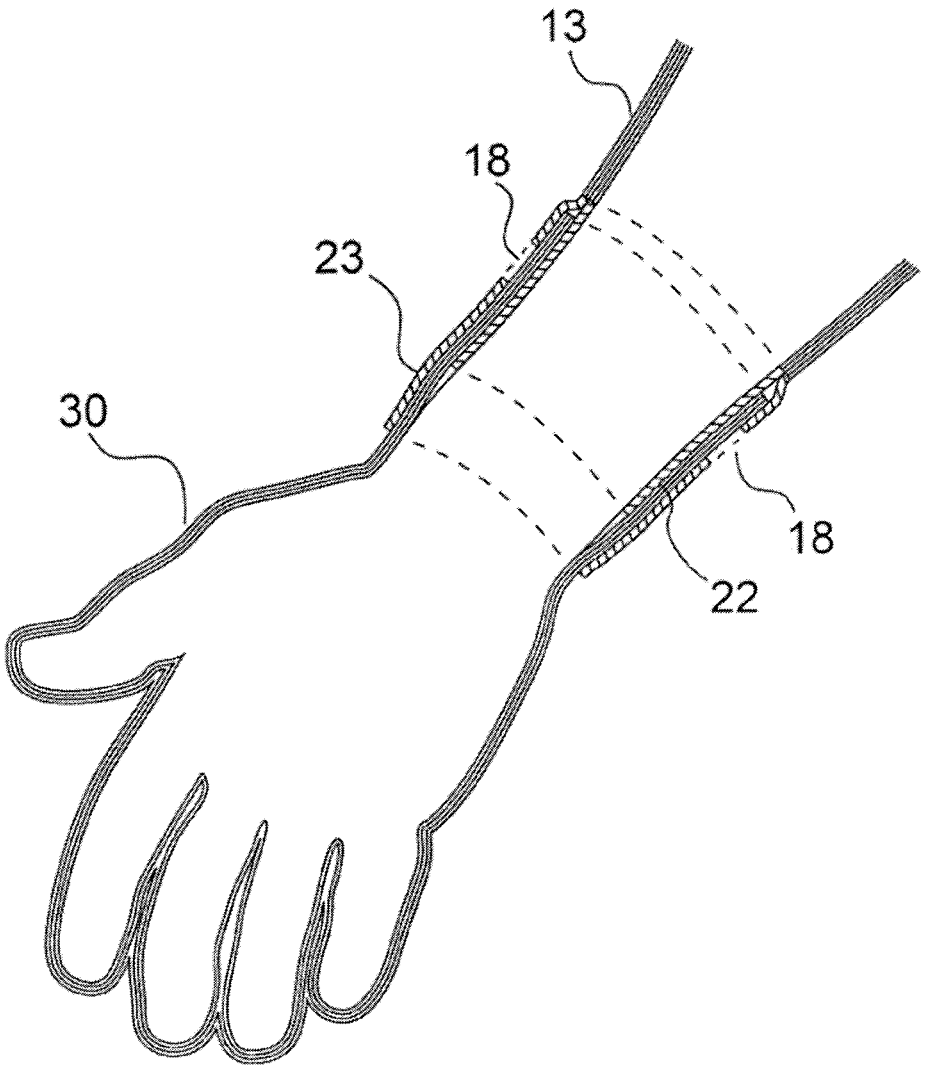

In one embodiment, it is advantageous for the user to also wear a glove, where such glove is preferably substantially watertight. Such embodiment is depicted in FIG. 15, which is similar to FIG. 12, but with the wrist cuff now frictionally holding and sealing to glove 30. To seal glove 30 to the user's wrist, glove 30 is interleaved at the wrist between outer wrist cuff 23 and inner wrist cuff 22. The circumference of outer wrist cuff 23 is preferably the same, or smaller, than the circumference of inner wrist cuff 22.

Figure 16:
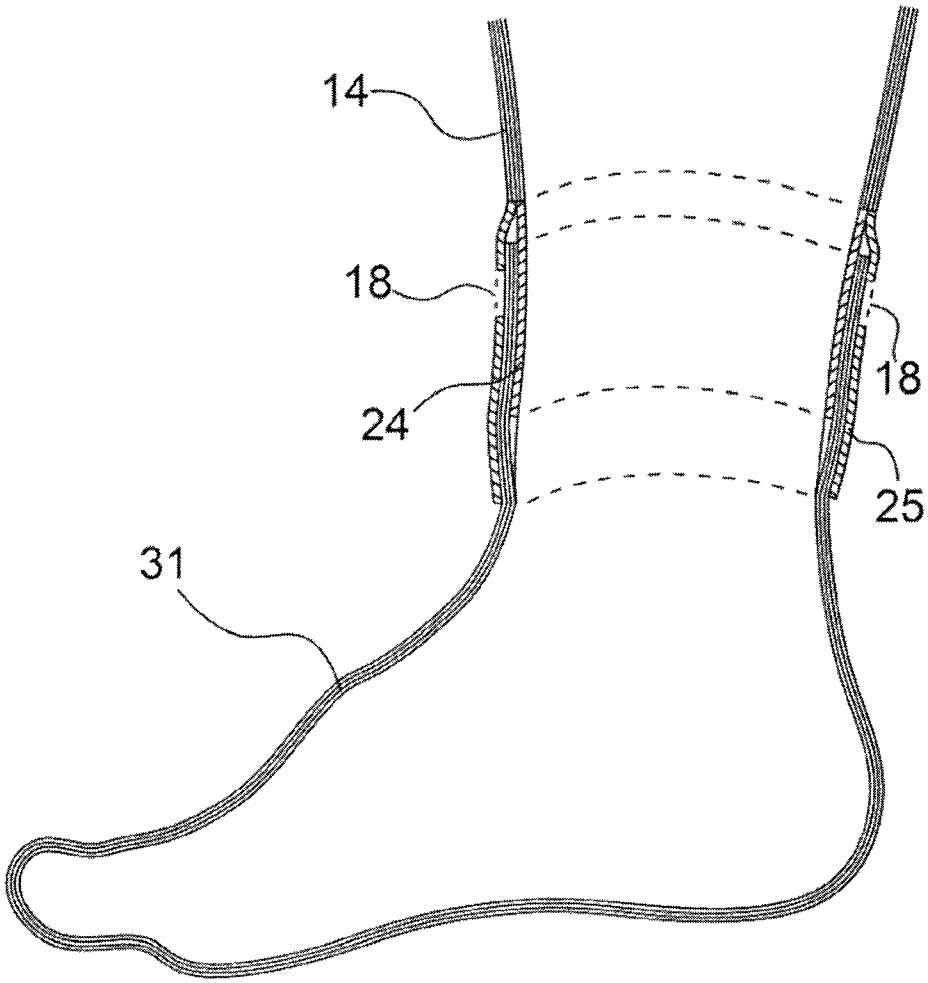

In another embodiment, it is advantageous for the user to also wear boots, where such a boot is preferably substantially watertight. Such embodiment is depicted in FIG. 16, which is similar to FIG. 15, but with the ankle cuff now frictionally holding and sealing to boot 31. To seal boot 31 to the user's ankle, boot 31 is interleaved at the ankle between outer ankle cuff 25 and inner ankle cuff 24, with diffuser holes shown as 18. The circumference of outer ankle cuff 25 is preferably the same, or smaller, than the circumference of inner ankle cuff 24.

Figure 17:
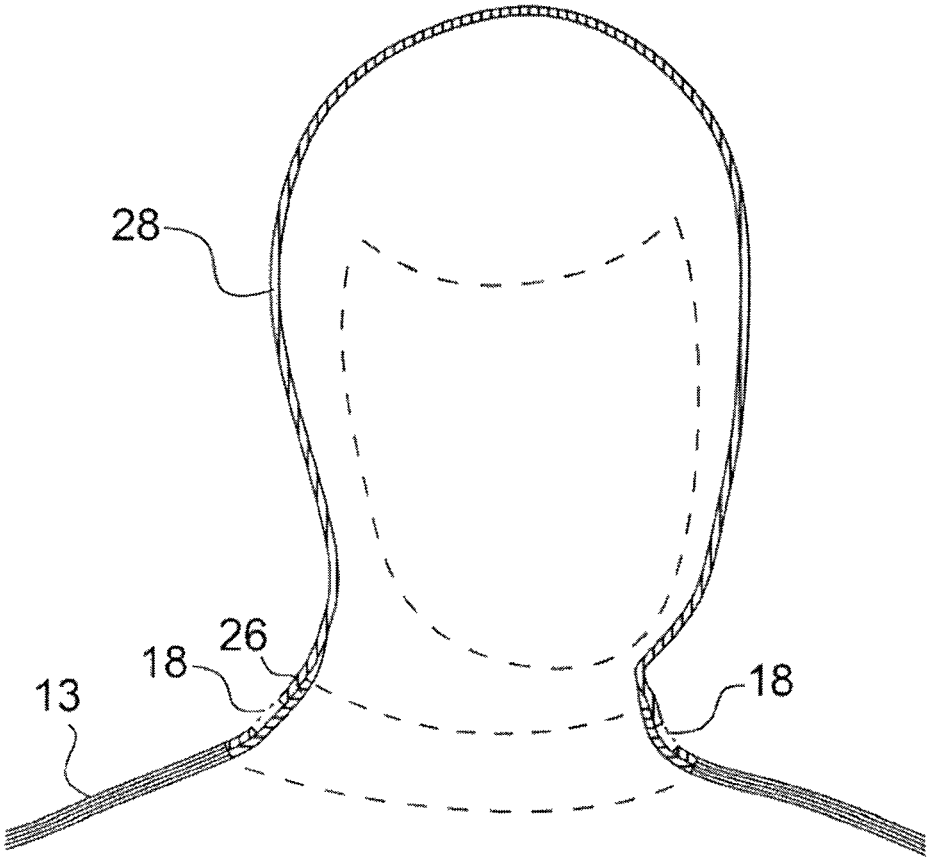

In some cold water situations, it is advantageous for the user to wear a hood, where such embodiment is shown in FIG. 17, with hood 28 covering the user's head, and attaching to upper body piece 13.

Figure 18:
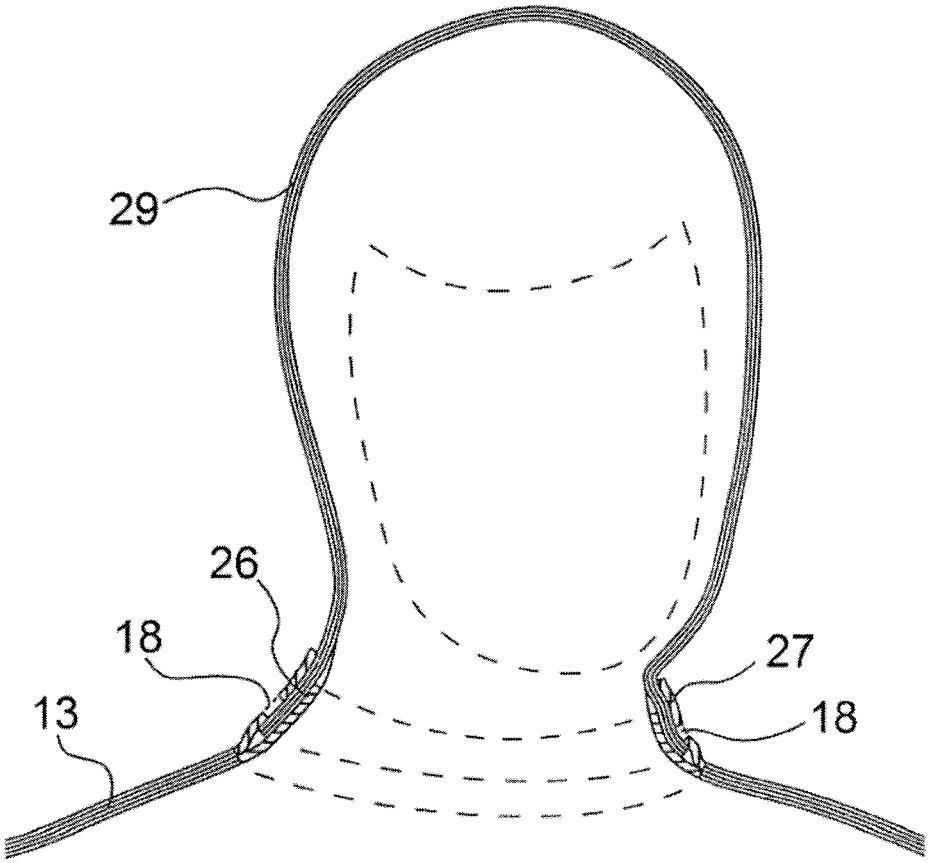

In some scenarios, it is also advantageous for the user to wear a removable hood, where such embodiment is shown in FIG. 18, with hood 29 covering the user's head, and attaching to upper body piece 13, and held in place by frictional forces induced by interleaving hood 29 at the neck between inner neck cuff 26 between outer neck cuff 27, and where the circumference of outer hood cuff 27 is the same, or preferably smaller, than the circumference of inner neck cuff 26.

Figure 19:
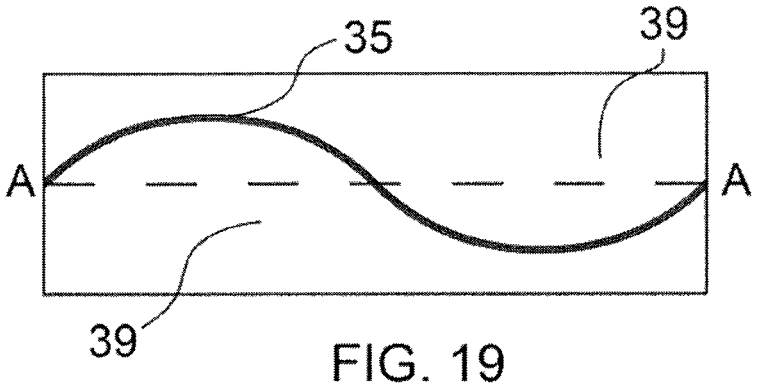

A key aspect in donning and doffing neoprene wetsuits is the strength and integrity of the seams holding together various suit panels, which panels are connected by adhesives and stitching, and are designed to be waterproof. High stress-loading at the seams can cause the scams to lose their waterproof property, and cause the glued areas to tear. Accordingly, one aspect of the current invention is to minimize such high stress-loading at the seams by connecting the various panels using curved seam pattern 39, as depicted in FIG. 19. Seam 35 has a sinusoidal shape, which shape, when stretched, will elongate by at least 110% of the distance between points A-A shown in FIG. 19.

Figure 20:
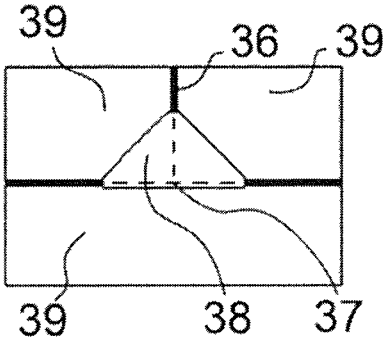
FIG. 20—Flat view of a 3 point seam intersection with a triangular shaped reinforcement FIG. 21—Flat view of a 3 point seam intersection with a triangular shaped reinforcement with concave sides FIG. 22—Flat view of a 4 point seam intersection with a diamond shaped reinforcement with concave sides FIG. 23—Front view of suit with one flap on upper section and one flap on lower section FIG. 24—Front view of suit with upper section partially connected to lower section FIG. 25—Hack view of suit with upper section partially connected to lower section FIG. 26—Side view of suit with upper section partially connected to lower section FIG. 27—Side view of suit with upper section partially connected to lower section, with upper section hinged forwards FIG. 28—Front view of partial suit with short arm sleeves and short leg sleeves FIG. 29—Sectional view of upper section connected to short arm sleeve FIG. 30—Sectional view of lower section connected to short leg sleeve

To further reduce the concentration of stress-loading at the seam junctions, such junctions, as shown in FIG. 20, can have triangular reinforcement patch 38 positioned at junction 37, thereby reducing stress-loading connecting suit panels 39. Alternatively, the triangular reinforcement patch can be shaped in a concave manner, as depicted in FIG. 21 as 38.

Figure 21:
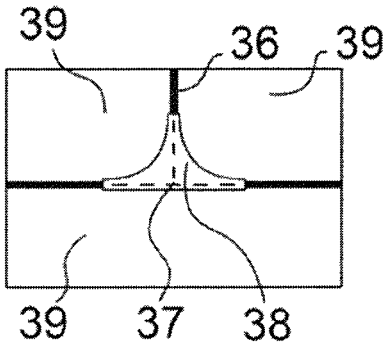
Figure 22:
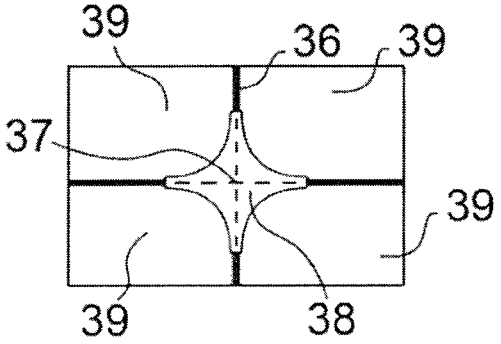
Figure 23:
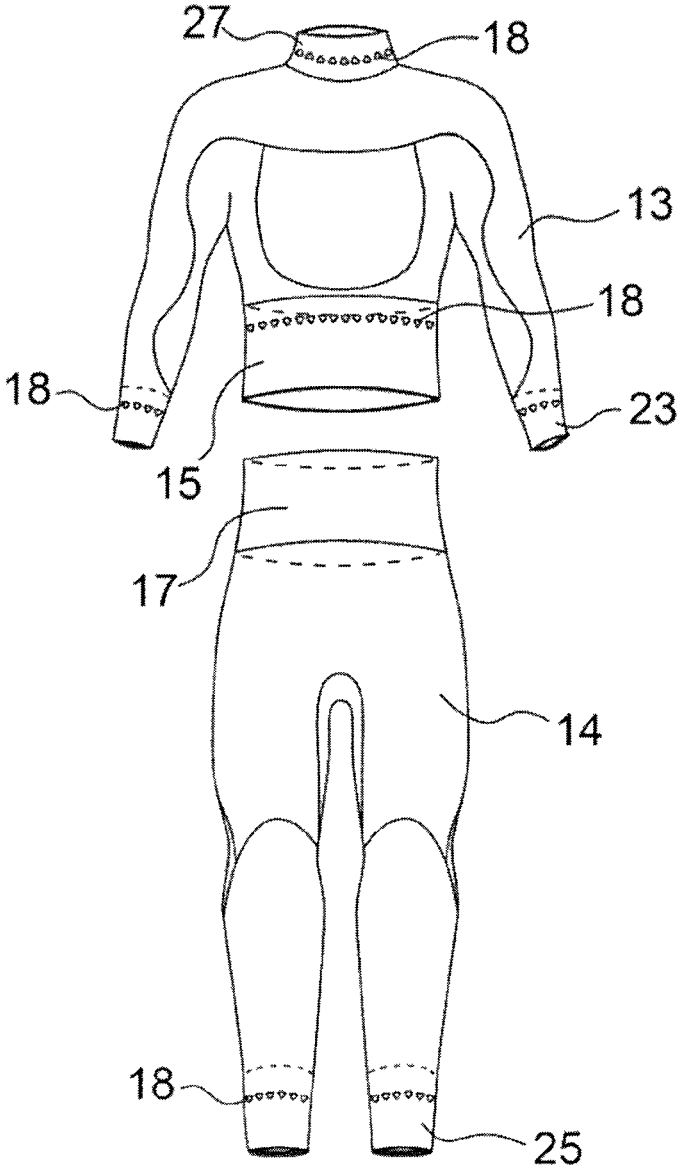

FIG. 22 is similar to FIG. 21, but now shows a 4-point seam intersection. With respect to connecting separate upper and lower sections of the friction-sealed water immersion wetsuit, in an alternative embodiment, such connection between the upper section flop and the lower section flap, can be accomplished by frictional forces holding, and sealing, such suit sections, as depicted in FIG. 23. In this embodiment, suit flap 15 overlaps suit flap 17, where the circumference of flap 15 is the same, or preferably smaller, than suit flap 17, and where the contacting flap surfaces comprise a high friction exposed closed-cell surface.

Figure 24:
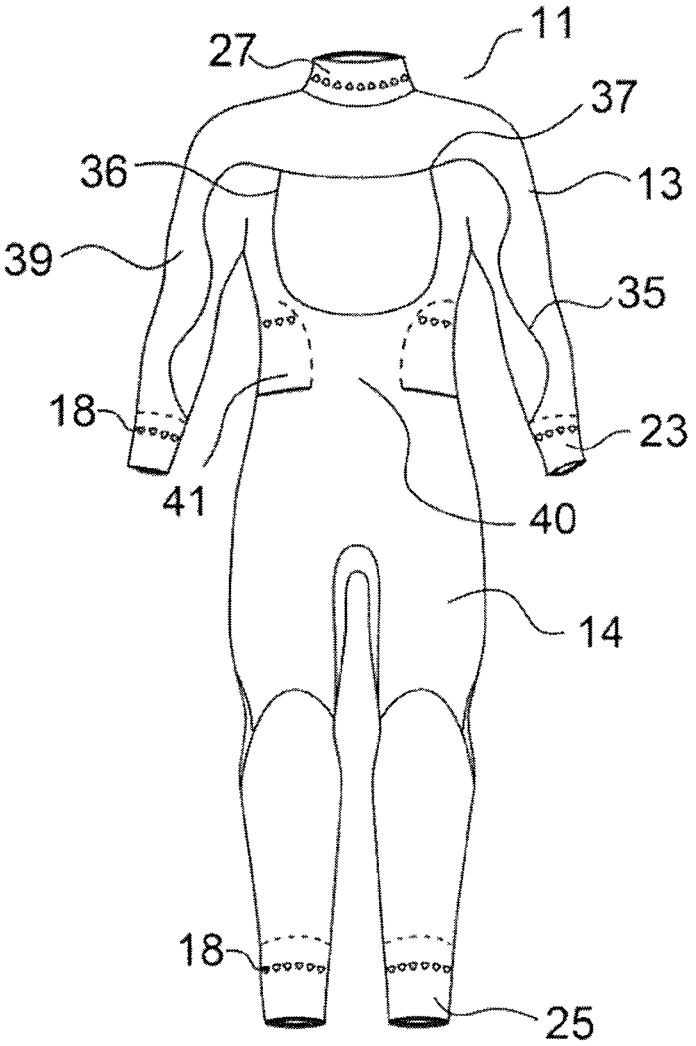

In yet a further embodiment, the friction-sealed water immersion wetsuit can be comprised of an upper section, and a lower section, where these sections are partially connected, or "hinged", as shown in FIG. 24. The area of partial connection is shown as 40, and the non-connected part as 41. The length of the non-connected part 41 is at least 50% of the horizontal circumference of the suit at this point on the torso. The non-connected part 41 can be connected, and sealed, by interleafing the tipper and lower parts in a manner analogous to that depicted and described for FIG. 1.

Figure 25:
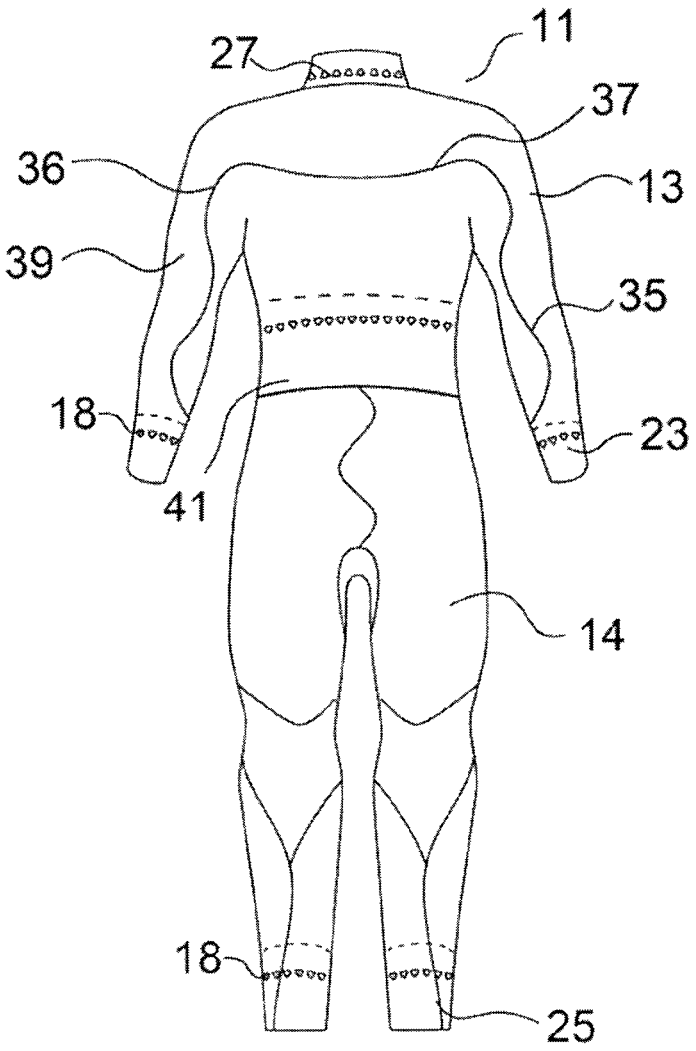
Figure 26:
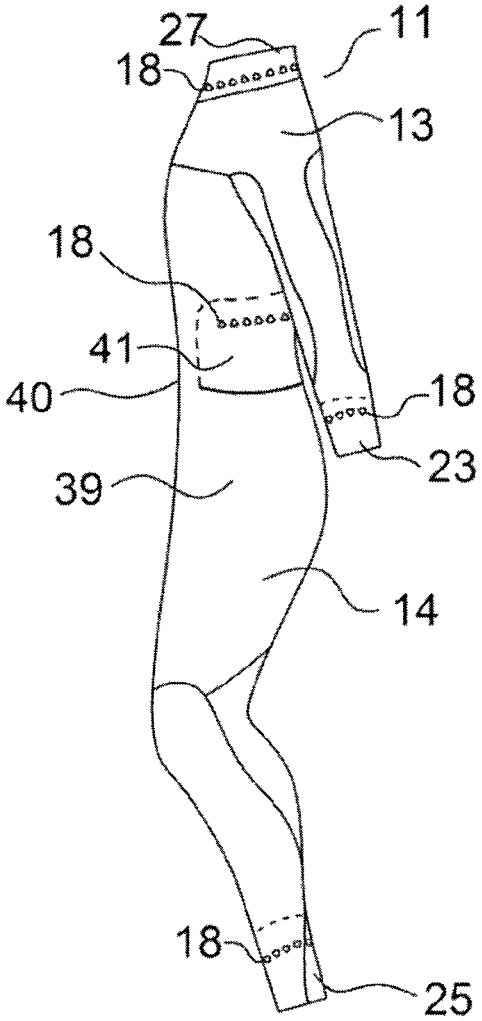
Figure 27:
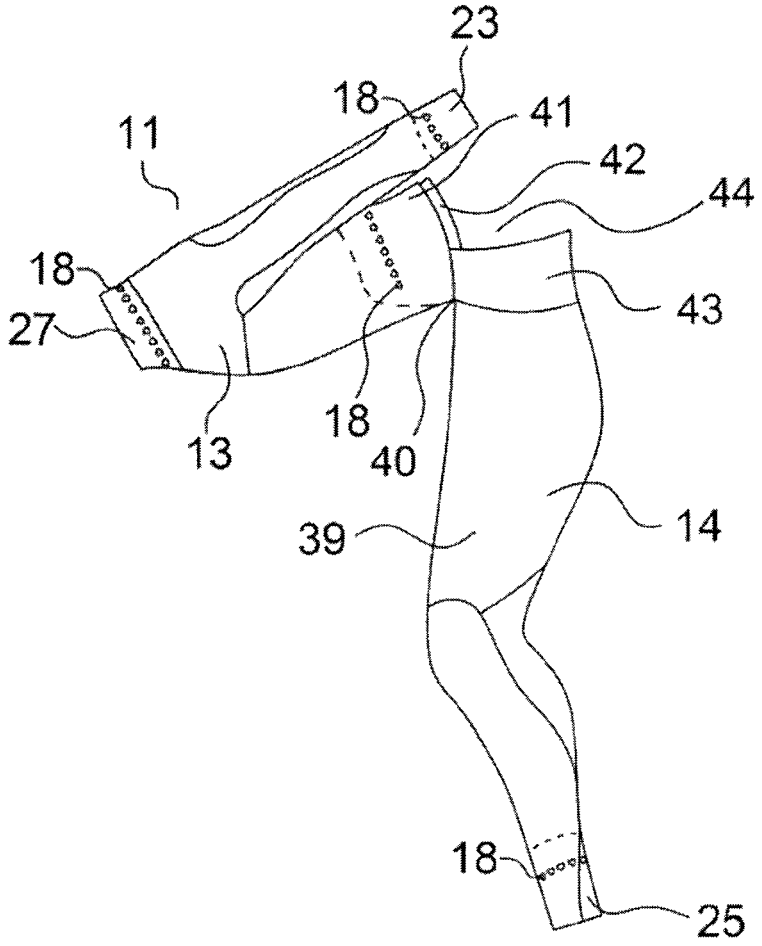

FIG. 25 shows the back side of suit 11 shown in FIG. 24. FIG. 26 is a side view of suit 11 with the upper section 13 partially connected to lower section 14. FIG. 27 is a similar view as FIG. 26, but now showing the upper section 13 hinged forwards.

Figure 28:
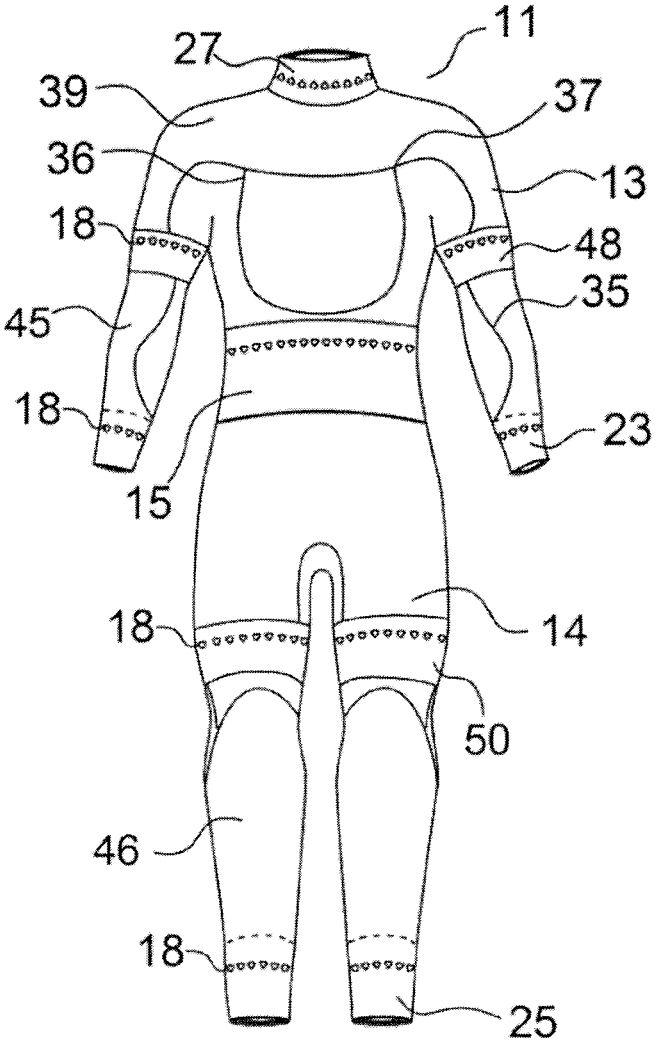

In another embodiment, friction-scaled water immersion suit 11 is comprised of separate arm and leg sleeves, illustrated by FIG. 28 which shows a front view of suit 11 with short arm sleeves 45, and short leg sleeves 46. Such embodiment provides the user with additional flexibility for wearing only part of suit 11, in, for example, warmer water. Short arm sleeves 45 and short leg sleeves 46 can be frictionally connected to the suit using a frictional holding and sealing approach as shown in FIG. 29 and FIG. 30.

Figure 29:
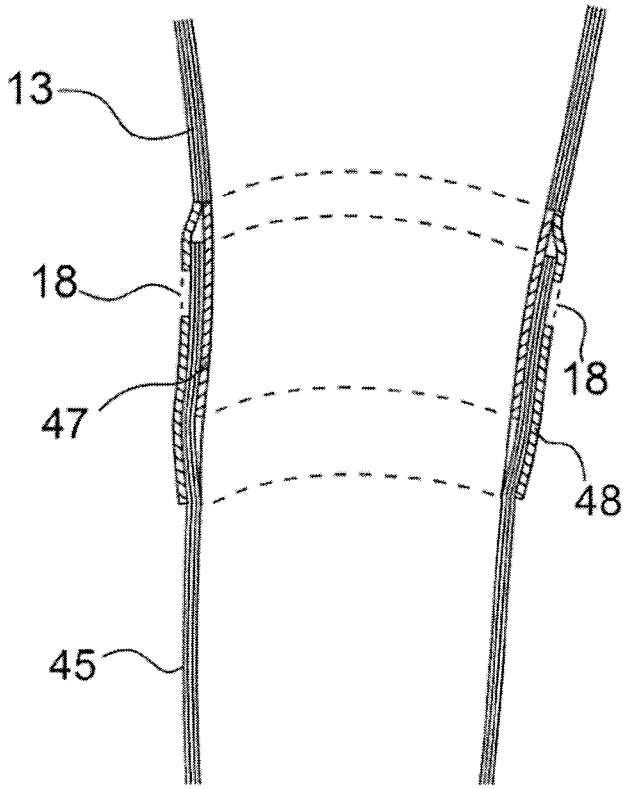

FIG. 29 shows a sectional view of upper section 13 connected to short arm sleeve 45, where arm sleeve 45 is interleaved, and frictionally held, between outer arm cuff 48 and inner arm cuff 47.

Figure 30:
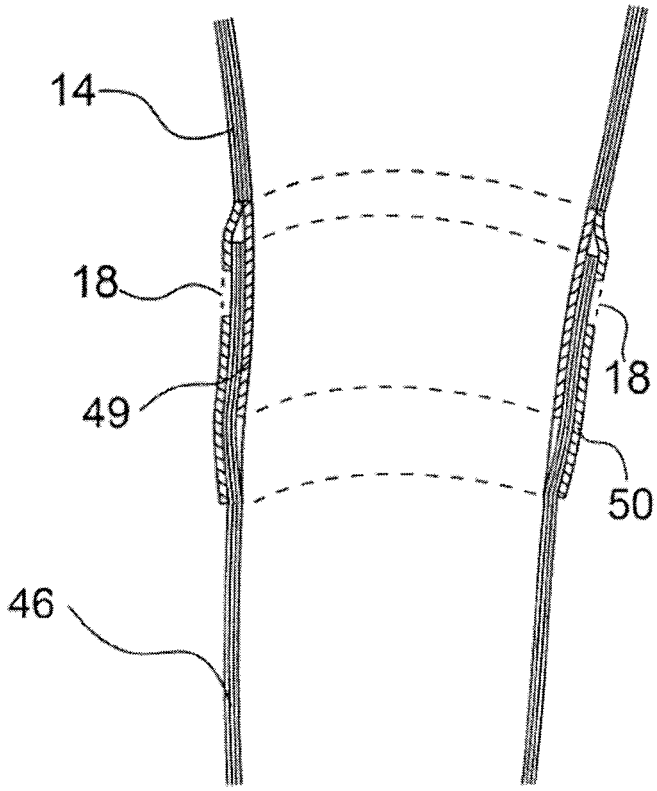

FIG. 30 shows a sectional view of upper section 14 connected to short leg sleeve 46, where leg sleeve 46 is interleaved, and frictionally held, between outer leg cuff 50 and inner leg cuff 49.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A friction-sealed water immersion suit comprising: a suit body having a neck opening, arm openings, leg openings and an entry opening, and the entry opening defining an upper section and a lower section; and the entry opening being sealed by friction by a friction-sealed coupling at the entry opening for coupling the upper section and the lower section of the suit body, the friction-sealed coupling using an interleaved engagement comprising an interleaving flap on one of the upper section or the lower section and an inner flap and an outer flap on the other of the upper section or the lower section; each of the interleaving flap, the inner flap and the outer flap being made of an elastomeric material, the friction-sealed coupling being engaged by interleaving the interleaving flap with the inner flap and the outer flap to create an outer seal between the interleaving flap and the outer flap, and an inner seal between the interleaving flap and the inner flap, the elastomeric material being a foam material that has exposed pores to create a high friction surface between an actual surface contact area of the interleaved engagement, and a circumference of a bottom edge of the outer flap being smaller than a circumference of a bottom edge of the inner flap.

2. The friction-sealed water immersion suit of claim 1, wherein the suit body is a one piece body with the upper section and the lower section being connected.

3. The friction-sealed water immersion suit of claim 1, wherein the suit body is a two piece body with the upper section and the lower section being separable.

4. The friction-sealed water immersion suit of claim 1, wherein said elastomeric material comprises a closed-cell foam.

5. The friction-sealed water immersion suit of claim 4, wherein said closed-cell foam comprises an exposed closed-cell neoprene.

6. The friction-sealed water immersion suit of claim 1, wherein said suit body includes at least one of a hood attached at the neck opening, gloves attached at the arm openings or boots attached at the leg openings.

7. The friction-sealed water immersion suit of claim 6, wherein said hood, said gloves or said boots are removably attached.

8. The friction-sealed water immersion suit of claim 6, wherein seals are positioned at the neck opening, the arm openings, and the leg openings comprising:

- a double layer of elastomeric material defining an inner sleeve and an outer sleeve;
- the inner sleeve providing a high-friction surface configured to contact skin of a user to provide a water tight seal;
- the outer sleeve providing mechanical support and thermal insulation to the inner sleeve, the outer sleeve being perforated with holes in an intermediate position along an engagement interface with the inner sleeve to provide water drainage for water migrating along the engagement interface so water exits without ballooning open the engagement interface and compromising the water tight seal.

9. The friction-sealed water immersion suit of claim 8, wherein said inner sleeve comprises one of silicone, latex, EPDM, NBR, natural rubber, or neoprene.

10. The friction-sealed water immersion suit of claim 1, wherein a static coefficient of friction between the interleaving flap with the inner flap and the outer flap is not less than 1.5.

11. The friction-sealed water immersion suit of claim 10, wherein the static coefficient of friction between said interleaving flap, inner flap and outer flap is greater than 2.0.

12. The friction-sealed water immersion suit of claim 1, wherein the actual surface contact area between the interleaving flap and the inner flap, and the interleaving flap and the outer flap, is larger than a geometric surface area.

13. The friction-sealed water immersion suit of claim 1, wherein a length of the interleaved engagement between the interleaving flap, the inner flap and the outer flap is at least 3 cm.

14. The friction-sealed water immersion suit of claim 1, wherein the length of the interleaved engagement between the interleaving flap, the inner flap and the outer flap is between 15 cm and 30 cm.

15. The friction-sealed water immersion suit of claim 1, wherein the suit body has panels connected by seams having a wavy sinusoidal seam pattern to improve stretch and reduce water intrusion via seam tear, and said wavy sinusoidal seam pattern, when the suit body is stretched, will elongate by at least 110% between two points along a linear line through a center of said wavy sinusoidal seam pattern, such that the seams having a wavy sinusoidal seam pattern are not stressed unless the suit body is stretched more than 110%.

16. The friction-sealed water immersion suit of claim 1, wherein the suit body has panels connected by seams with seam junctions and one of a triangular three-point shaped patch or a four-point shaped patch is positioned at the seam junctions with each seam extending from one point of the three-point shaped patch or the four-point shaped patch to reduce stress-loading.

17. The friction-sealed water immersion suit of claim 1, wherein where the upper section and the lower section of said suit body both comprise neoprene.

18. The friction-sealed water immersion suit of claim 1, wherein the upper section of said suit body comprises a waterproof nylon shell material and the lower section comprises neoprene.

19. The friction-sealed water immersion suit of claim 1, wherein the lower section of said suit body comprises a waterproof nylon shell material and the upper section comprises neoprene.

20. The friction-sealed water immersion suit of claim 1, wherein the body suit comprises arm sleeves and leg sleeves, wherein one of the arm sleeves or the leg sleeves are removable.

21. The friction-sealed water immersion suit of claim 1, wherein the interleaving flap is on the lower section with the inner flap and the outer flap positioned on the upper section.

22. The friction-sealed water immersion suit of claim 1, wherein the outer flap is perforated with holes in an intermediate position along an engagement interface where the outer flap engages the interleaving flap to form the outer seal, the holes providing water drainage for water migrating along the engagement interface so water exits without ballooning open the engagement interface and compromising the outer seal.

* * * * *